US005570666A

United States Patent [19]

Rymut et al.

[11] Patent Number: 5,570,666

[45] Date of Patent: Nov. 5, 1996

[54] GLOW PLUG CONTROLLER

[75] Inventors: Michael J. Rymut, Cadillac; Mario P. Boisvert, Reed City; Ronald D. Ingraham, Reed City; Frederick C. Simar, Reed City, all of Mich.

[73] Assignee: Nartron Corporation, Reed City, Mich.

[21] Appl. No.: 42,239

[22] Filed: Apr. 1, 1993

Related U.S. Application Data

[63] Continuation-in-part of Ser. No. 785,462, Oct. 31, 1991, abandoned.

[51] Int. Cl.[6] ..... F02P 19/02

[52] U.S. Cl. ..... 123/145 A; 123/179.6

[58] Field of Search ..... 123/145 A, 179.6; 219/494

[56] References Cited

U.S. PATENT DOCUMENTS

| | | | |
|---|---|---|---|
| 4,088,109 | 5/1978 | Woodruff et al. | 123/179.6 |
| 4,137,885 | 2/1979 | Von Ostrom | 123/179.6 |
| 4,375,205 | 3/1983 | Green | 123/145 A |
| 4,512,295 | 4/1985 | Hanson | 123/145 A |
| 4,516,543 | 5/1985 | Abe et al. | 123/145 A |
| 4,862,370 | 8/1989 | Arnold et al. | 123/145 A |
| 4,939,347 | 7/1990 | Masaka et al. | 123/179.6 |
| 5,241,929 | 9/1993 | Grassi et al. | 123/179.6 |
| 5,327,870 | 7/1994 | Boisuert et al. | 123/179.6 |

*Primary Examiner*—Noah P. Kamen

*Attorney, Agent, or Firm*—Watts, Hoffmann, Fisher & Heinke Co. L.P.A.

[57] ABSTRACT

An improved glow plug controller is disclosed. The glow plug controller includes an analog temperature sensor, circuitry for converting an analog temperature signal to digital form, a microprocessor for analyzing temperature and other operating parameters and for controlling glow plugs and monitoring indicators in accordance with algorithms defined in the microprocessor. The temperature and control signals from the microprocessor are converted to analog form and applied to actuate glow plugs and indicators in accordance with determinations made by the microprocessor. A specific embodiment includes a manual override for facilitating operation even if the microprocessor should fail. A false temperature input is provided so that a false temperature representation can be directly applied to the microprocessor for factory and service center testing of microprocessor operation. Glow plug operation is controlled by way of a relay and multiple, independently fused glow plug circuits. Diagnostic means are provided for indicating to an operator when a glow plug short circuit has caused a fuse to open the glow plug circuit, and to indicate as well the number of such circuits which have been opened by short circuit malfunctions. Disabling means are provided for cutting off power to the glow plugs in response to engine temperature exceeding a predetermined maximum of 88° Celsius. The programmed microprocessor includes means for establishing a preglow period as a function of engine temperature, and for initiating the afterglow in response to the cessation of cranking the engine.

14 Claims, 20 Drawing Sheets

GLOW PLUG CONTROLLER

CROSS-REFERENCE TO RELATED APPLICATIONS

The present application is a continuation in part of U.S. application Ser. No. 785,462, filed Oct. 31, 1991, now abandoned. Priority under 35 USC 120 of these patent applications is claimed.

FIELD OF THE INVENTION

This invention relates generally to the field of diesel powered vehicles, and more particularly to improved controller circuitry, and mounting and housing structure therefor, for governing operation of the glow plugs of the engine of such a vehicle.

BACKGROUND ART

The present invention is intended for use in an environment of a self-propelled vehicle or other piece of equipment which is powered by a known form of internal combustion engine. The invention is preferably designed for use in connection with a vehicle or other equipment powered by a diesel engine.

Diesel engines do not use spark plugs. Rather, they rely for ignition of the fuel-air mixture on compression of that mixture by rapid motion of a piston to reduce the volume of a fuel-air charge in the combustion chamber.

When a diesel engine is started, however, known glow plugs are used to assist in providing engine starting ignition. The glow plugs typically are operated for a brief time.

Vehicles of the type forming the environment for the present invention are commonly heavy-duty military and commercial vehicles such as trucks, buses, infantry fighting vehicles, tanks, and others. Because such vehicles are typically operated by a large number of operators having different skill levels, considerable warning and protection equipment is incorporated into such vehicles. This warning and protection equipment includes means for informing an operator of the operations and conditions of certain vehicle and engine components.

The glow plugs of diesel engines are commonly controlled by a glow plug controller circuit. The glow plug controller circuit, upon an operator turning on the ignition, applies a high DC current, often in the neighborhood of 150 amps, to the glow plugs continuously during what is known as a "preglow" mode. A sensor detects the temperature of the engine and controls the preglow mode which endures for a period of time, typically 3–8 seconds. Following the preglow portion of the cycle, the glow plug controller shifts to an "afterglow" portion of the cycle. During the afterglow portion, the glow plugs are continued in pulsed operation for a time that is fixed for a given sensed temperature. Sometimes, during the afterglow cycle, the duty cycle of the glow plugs is adjusted, the duty cycle being reduced as the ambient engine temperature rises prior to glow plug cut-off.

FIG. A is a partial schematic, partial block diagram illustrating some of the electrical components of a diesel engine and associated peripheral equipment which form the environment for the present invention. The items illustrated in FIG. A do not form part of the present invention per se, but rather are known components in connection with which the present invention, described in detail in succeeding sections, operates. The components illustrated in FIG. A are all known and within the skill of one ordinarily conversant with the relevant art. FIG. A, and this description, is provided for the benefit of those not intimately familiar with this art. FIG. A is not intended as a detailed schematic description of these known components. Rather, FIG. A is intended only for a general understanding of the relationship among these components.

Toward the left-hand portion of FIG. A is a column of eight glow plugs, the uppermost of which is indicated by the reference character G. Operation of the glow plugs is governed by a glow plug controller indicated as GPC. An electric starter motor M, with associated switching, is provided for starting the engine. Batteries B are provided for selectively actuating the starter motor M, and for providing DC electrical power for operating other electrical components of the vehicle and for peripheral components of the engine as needed. The vehicle batteries provide 24 volts DC. The vehicle operates, while running, at 28 volts. Preferably, two batteries in series are provided.

A run/start switch RS is provided for actuating the vehicle ignition circuitry and for selectively actuating the starter.

An alternator A, driven by the engine, provides electrical power for charging the batteries B for providing electrical power to the vehicles loads. The alternator A has an "R tap," (connected to the field) indicated by reference character R.

A fuel solenoid F governs flow of fuel to the engine.

A clutch control C electrically engages and disengages an electric motor driven engine cooling fan.

A wait-to-start lamp W provides a visual indication to an operator when the preglow cycle is occurring and it would thus be inappropriate to try to start the diesel engine. A brake warning lamp BW indicates to the operator when a parking brake is set. The brake warning lamp BW also indicates when the start solenoid is engaged. A brake pressure switch BP provides an indication to the operator when a predetermined amount of force is applied to the service brake pedal. A park brake switch PB, indicates by means of the lamp that the vehicle parking brake is set.

The electrical system of the engine operates several types of electrical loads. One such load is a heater motor indicated generally at the reference character H. Lighting loads are connected to a lead generally indicated by the reference character LL. Certain miscellaneous electrical vehicle loads are indicated by the resistor at reference character VL.

The present invention, as will be described in detail, includes improved circuitry and sub-circuits for governing and safe-guarding operation of the known components illustrated in FIG. A. Interfaces for connecting the known components of FIG. A are provided by an engine connector C1 and a body connector C2, both illustrated in FIG. A. These connectors interface between the inventive circuitry (not shown in FIG. A) and the engine and vehicle components shown in FIG. A.

The concept of controlling glow plugs with solid state controller devices including clocking circuits regulating such functions as glow plug preheat and afterglow control, as well as control of the duty cycle of glow plugs, and temperature related control, is well known. For example, Arnold et al., U.S. Pat. No. 4,862,370, shows a solid state microprocessor controlled device for regulating many aspects of glow plug performance. The Arnold circuitry adjusts the duty cycle of glow plugs as a function of temperature, regulates preglow function, and detects undesirable short circuits and open circuits for implementing a disable function. U.S. Pat. No. 4,300,491, to Hara et al., achieves a variable time control of the preglow period by means of a plurality of transistors and diodes. Van Ostrom, U.S. Pat. No. 4,137,885 describes means for cyclicly interrupting a glow plug energizing circuit when a maximum temperature is reached. Cooper, U.S. Pat. No. 4,312,307 describes circuitry for control of the duty cycle of glow plugs by means of heat-sensitive switches. Each of the above-identified United States patents listed in this paragraph are hereby expressly incorporated by reference.

The applicant also expressly incorporates by reference the disclosure of U.S. Pat. No. 5,327,870, in the name of Boirvert et al. for GLOW PLUG CONTROLLER, said application being assigned to the assignee of the present application.

It is a general object of the present invention to provide improved glow plug controller circuitry, and mounting and housing structure for such a glow plug controller, to enhance the precision and efficiency of control of operation of the glow plugs of a diesel engine, and to enhance the durability, reliability and ease of assembly of the glow plug controller.

DESCRIPTION OF THE INVENTION

The disadvantages of the prior art are reduced or eliminated by the present invention, one embodiment of which provides an improved glow plug controller for governing application of electrical power to a glow plug in a diesel engine. The glow plug controller comprises a sensor for producing an analog temperature signal and an analog to digital converter for converting the analog temperature signal to digital form. The controller further includes digital circuitry for producing a glow plug control signal in response to the digitized temperature signal and a digital to analog converter for converting the digital control signal back into analog form and for applying the analog converted digital control signal to control application of the electrical power to the glow plug. The conversion of the temperature signal to digital form enables its processing by digital circuitry which is reliable, versatile and durable, enabling the glow plug controller to function well in a hostile environment which may include severe temperature changes and physical vibration.

According to a more specific embodiment, the digital circuitry comprises a microprocessor for swiftly and accurately generating the ideal glow plug control for a variety of situations, taking into account many variables.

In another specific embodiment, means is provided for manual override by an operator of microprocessor control of the electric power application to the glow plugs. This feature affords the flexibility of continuing operation even if the microprocessor or other parts of the digital circuitry should malfunction.

In accordance with another specific embodiment, the glow plug controller further includes circuitry for defining an artificial input representing a temperature from a source other than the actual temperature sensor for facilitating testing of performance without an input signal representing an actual temperature. This enables factory testing at any temperature.

According to another embodiment of the invention, there is provided a system governing the application of electrical power to a glow plug in a diesel engine. The system includes a circuit connecting the glow plug with a source of electric power and a relay for selectively opening and closing the circuit. The circuit also includes a fuse interposed therein, in addition to the relay, and glow plug controller circuitry for controlling operation of the relay in response to a signal representing an engine parameter. Finally, the system includes a sensor for producing a signal representing the engine parameter to enable selective opening and closing of the relay in the fused circuit. Fusing of the glow plug enables use of a smaller relay than would be possible without the fuse, because the relay does not have to bear the full current of a glow plug short. Consequent arcing is minimized.

According to a more specific embodiment, the controller includes circuitry for monitoring whether the fuse has broken the connecting circuit. Such fusing and monitoring facilitates detection of a short in the glow plug or in the connecting circuit. When a short occurs, if power is applied, the fuse opens the connecting circuit, and the monitoring device indicates that a short circuit condition has occurred, warning the operator of the need for an appropriate response. Operation continues with remaining operable glow plugs, if any.

According to a more specific embodiment, the system further comprises indicator circuitry for producing an indication in response to the monitoring circuitry for indicating when a fuse has opened the connecting circuit.

Where the engine has a plurality of glow plugs and a plurality of the connecting circuits, the system further includes each of the connecting circuits having a fuse interposed therein and the monitoring circuitry and indicator circuitry comprise means for indicating to an operator the number of circuits which have opened by virtue of the fuses. According to a more specific embodiment, where the diesel engine includes an even number of glow plugs, the system further comprises a plurality of control circuits with each control circuit connecting a unique pair of the glow plugs to an electric power source.

According to another specific embodiment, the monitoring circuitry operates by causing a wait lamp to flash, rather than to burn continuously, in response to the detection of a connecting circuit which is opened by its associated fuse.

According to another embodiment of the invention, a system is provided for controlling operation of a glow plug in a diesel engine, the system including a temperature sensor and circuitry coupled to the temperature sensor for operating the glow plug as a function of sensed temperature. Additionally, the embodiment includes circuitry for inhibiting a function in response to sensing of a temperature greater than a predetermined maximum. More specifically, the predetermined maximum is determined at 88° Celsius.

According to another feature of the invention, a system is provided for governing application of electrical power to a glow plug in a diesel engine, the engine including means for cranking the engine for starting, the system having a user control switch, and user controlled apparatus and circuitry for actuating the cranking means, along with circuitry for providing a cranking signal only when the cranking means is providing engine cranking. The glow plug controller includes circuitry actuable by the user controlled switch for applying electrical power to the glow plug in a preglow period, and circuitry responsive to cessation of the cranking signal to apply electrical power to the glow plug in an afterglow period, the afterglow period being defined as initiating in response to cessation of the cranking signal. This aspect to the invention provides a "customized" initiation for the afterglow period which is substantially coincident with engine starting. Thus, the preglow period is terminated upon engine starting, and the afterglow period is begun when the engine starts. This has the advantage of adapting the application of electric power in the afterglow mode following starting of the engine, after which application of the power in a mode different from the preglow mode is advantageous.

In a more specific aspect, the invention includes circuitry for applying electrical power to the glow plug during actual engine cranking, as well as before and after the cranking period. An additional specific aspect includes an indicator for providing an indication to the user that the afterglow period has been initiated. A further specific aspect includes means for providing to the user an indication of the termination of the preglow period. These features provide the operator with additional information on the operating mode of the glow plugs during preglow and through the expiration of the afterglow period.

DESCRIPTION OF THE DRAWINGS

FIG. A is a partially schematic, partially block diagram illustrating some of the electrical components of a diesel engine and associated peripheral equipment which form the environment for the present invention.

BEST MODE FOR CARRYING OUT THE INVENTION

GENERAL DESCRIPTION OF PREFERRED EMBODIMENT

The preferred embodiment of this invention comprises a glow plug control module which utilizes a microprocessor and one relay to control the operation of eight glow plugs in a diesel engine. This section outlines the principal features of the controller requirements for the glow plug controller. This description is directed to a glow plug control unit to be used on a diesel engine model 8V-71 Low Heat Rejection Engine, manufactured by the Detroit Diesel Corporation of Detroit, Mich., USA. The glow plug controller assists in low temperature engine starting by energizing the glow plugs for pre-set times before and after engine cranking takes place. The unit preferably is housed to meet requirements for water-proof housings as set forth in United States government regulations.

CONFIGURATION

Figure 1:
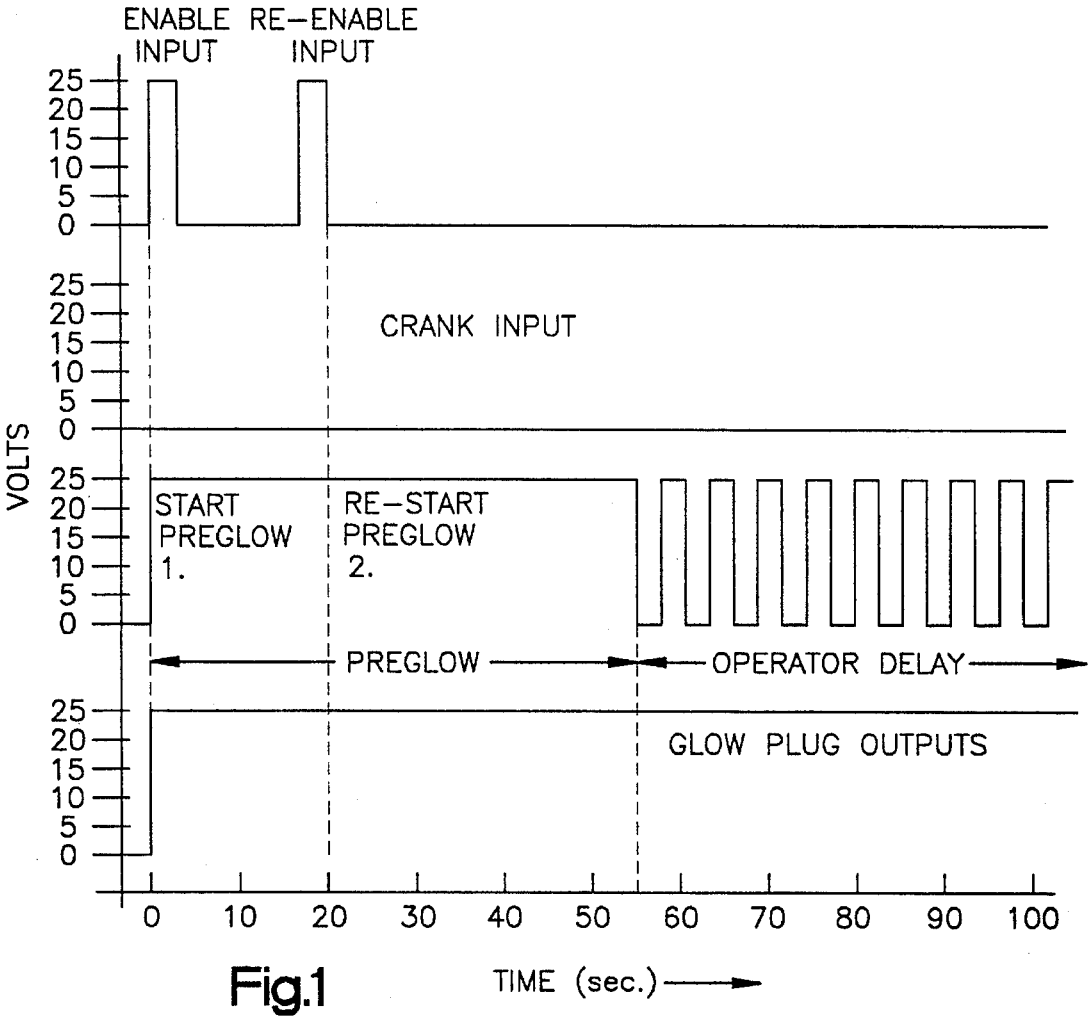
FIG. 1 is a signal timing diagram at pre-enable condition showing pre-glow of 20 seconds, restart pre-glow of 35 seconds, with a 60 second operator delay.

The glow plug controller inputs and outputs are illustrated in accompanying schematic drawing FIGS. 12A through 12F, which are discussed in detail below. The system requires the following inputs and outputs:

INPUTS a. A battery source, preferably 24 volts DC nominal, to power the glow plug control system. Two independent conductors connect battery power from the diesel engine starter motor.

b. A battery ground extends from the starter motor.

c. An ENABLE and MANUAL OVERRIDE signal from a non-latching, normally open switch actuated when desired by a vehicle operator. The control cycle is enabled by the rising edge of the signal, low (less than 1 volt DC) to high (greater than 10 volts DC) transition of the enabled signal. Additional enable signals received during the control cycle reset it on the falling edge, high (at least 10 volts DC) to low transition of the enable signal. This sequence is illustrated by the timing diagram of FIG. 1. The duration of the enable signal must be greater than 0.1 seconds. A manual override input is active while a high signal (greater than 10 volts DC) is present. The input shall sink less than 100 milliamperes (mA).

d. An ENGINE CRANK signal from the starter solenoid. A low (less than 1 volt DC) to high (greater than 10 volts DC) signal transition marks the end of operator delay. (The operator is cranking the engine.) The controller then waits for the high to low transition, at which time the pre-glow period terminates, if the pre-glow period is in effect, and the after glow period shall begin. This input shall sink less than 100 mA.

OUTPUTS a. This output is a signal which controls the eight glow plugs. When enabled, this output voltage is greater than battery voltage minus 1.5 volts DC, while sourcing 5.75 amps maximum to each glow plug (46 amps total). A single output relay is provided to gate power to four pairs of glow plugs and incorporate a fuse for each pair of glow plugs and other circuits means necessary to ensure the relay contacts and all other controller circuit paths are not damaged at continuous currents greater than 30 amps per group glow plug pair. The replaceable fuses are accessed by removing a gasketed inspection plate (described below) located on a base of the unit, as shown in FIG. 23. When disabled, no current flows through the glow plugs.

b. This output is a signal which controls an instrument panel mounted wait/pilot lamp. When enabled, the output voltage must be greater than battery voltage minus 1 volt DC, while sourcing 0.75 amps, maximum at 28 volts DC. When disabled, the output voltage is less than 1 volt DC with a leakage current of less than 1 mA with the lamp connected.

GENERAL OPERATION SUMMARY

The glow plug controller system is enabled in response to the closure of the switch labeled ENABLE/OVERRIDE. After enablement, the following upgrading sequence occurs.

a. The controller latches an internal power supply in its "on" state and reads the engine temperature from an internal controller temperature sensor located in close proximity to a housing which encloses the controller. The controller then looks Up the corresponding optimum pre-glow time from a table in memory, the memory comprising either an EPROM or a MASK. The range and resolution of the pre-glow time versus controller sensed temperature is illustrated in Table 1. The pre-glow time can be designated from 0 to 80 seconds with one second resolution for temperatures ranging from –400° Celsius to +50° Celsius in three degree increments.

The after glow time is a designated constant ranging from 0 to 120 seconds with one second resolution. The preglow and after glow times are accurate to within one second.

b. For all controller sensed temperatures equal to or less than 11° Celsius, the preglow time is 35 seconds, and the after glow time is 60 seconds. Above 11° Celsius, the pre-glow and after glow times shall be 0 seconds. Table 2 lists the chosen pre-glow and after glow table values.

c. The wait/pilot lamp is controlled for a one second bulb check before the glow plug relay is actuated.

Figure 2:
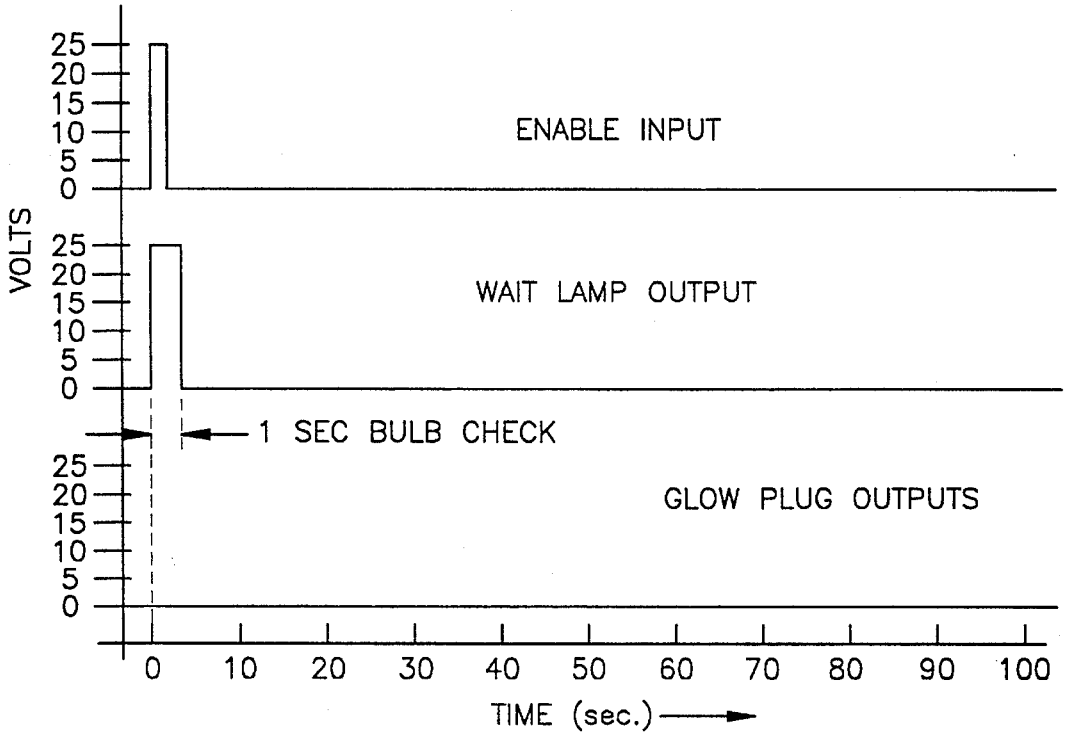
FIG. 2 is a timing diagram with 0 seconds of pre-glow.
Figure 2A:
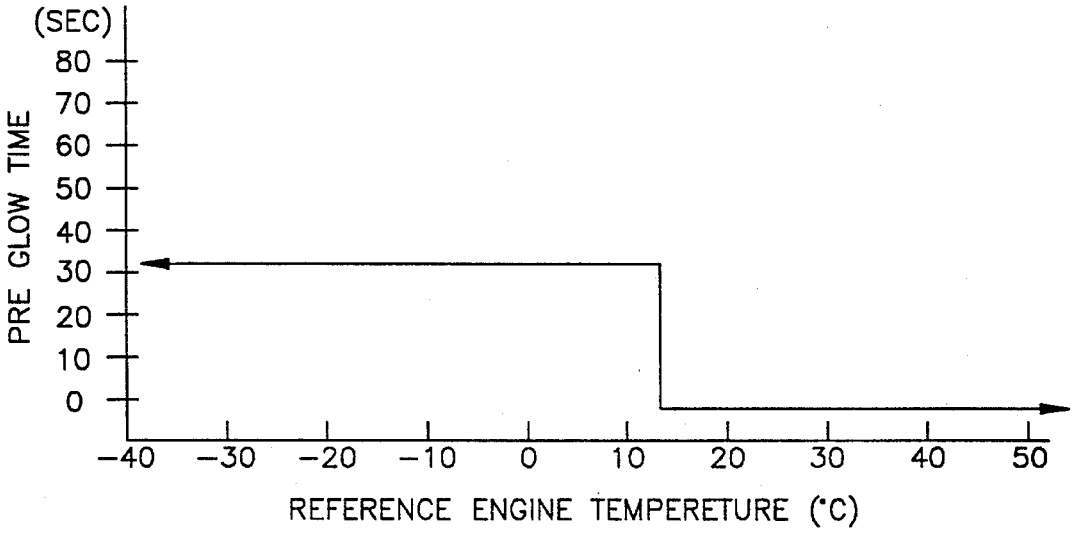
FIG. 2A is a plot of preglow time vs engine temperature with an after glow of 60 seconds.
Figure 3:
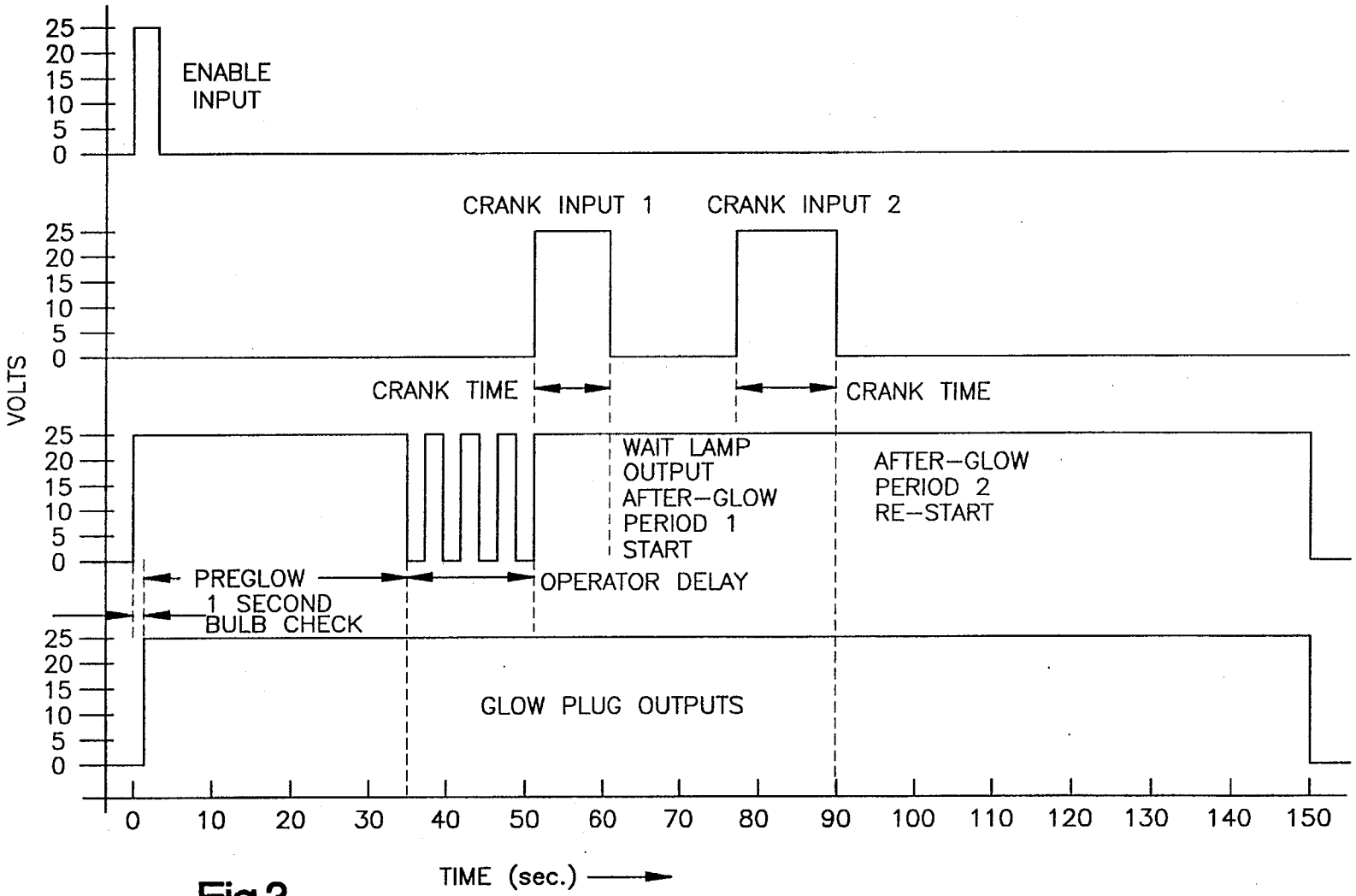
FIG. 3 is a timing diagram for multiple crank inputs, with 35 seconds of pre-glow and 15 seconds of operator delay illustrating a 30 second after-glow and a 60 second restart after-glow.
Figure 4:
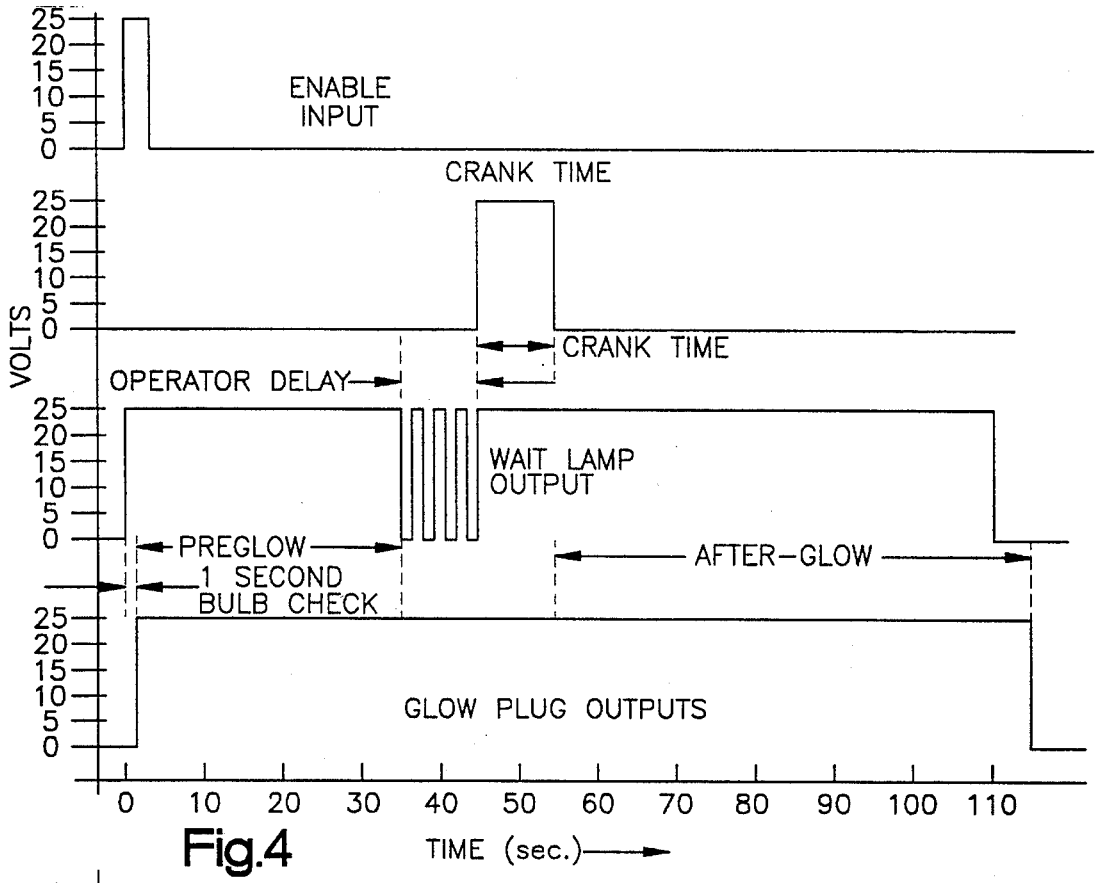
FIG. 4 is a timing diagram for 35 seconds of pre-glow, 10 seconds of operator delay, 10 seconds of crank time, and 60 seconds of after-glow.

If the pre-glow time is 0 seconds, the power supply is toggled off at the end of the bulb check. This sequence is illustrated in the timing diagram of FIG. 2.

d. For pre-glow times greater than 0 seconds, the controller initiates the pre-glow period by enabling the glow plugs and the wait/pilot lamp. The pre-glow period allows the glow plugs to reach their operating temperature. When the pre-glow time has expired, the wait/pilot lamp flashes at a 1 second ±0.2 second repetition rate with a 50% duty cycle, prompting the operator to crank the engine. The operator delay is the time between the end of the pre-glow and the low to high transition of the crank input. The cranking period is the time that the cranking input is high. When a crank period is initiated, the wait/pilot lamp terminates flashing and resumes continuous operation. When the crank input undergoes a high to low voltage transition, the after glow period begins. Additional crank inputs received during after glow shall restart the after glow period on the falling edge of the crank input. This sequence is illustrated in a timing diagram of FIG. 3. The after glow period aids combustion when the engine is coming up to rated speed. The glow plugs will be disabled and the internal power supply toggled off when the after glow time has expired. The timing diagram of FIG. 4 illustrates this sequence for 35 seconds of pre-glow, 10 seconds of operator delay, 10 seconds of cranking and 60 seconds of after glow.

e. The maximum allowable operator delay between the end of the pre-glow and the beginning of the crank period shall be a programmable constant ranging from 0 to 120 seconds with 1 second resolution. It shall be set to 60 seconds. If no crank input is received during the 60 seconds, then the controller disables the glow plugs, the wait/pilot lamp, and the internal power supply.

Figure 5:
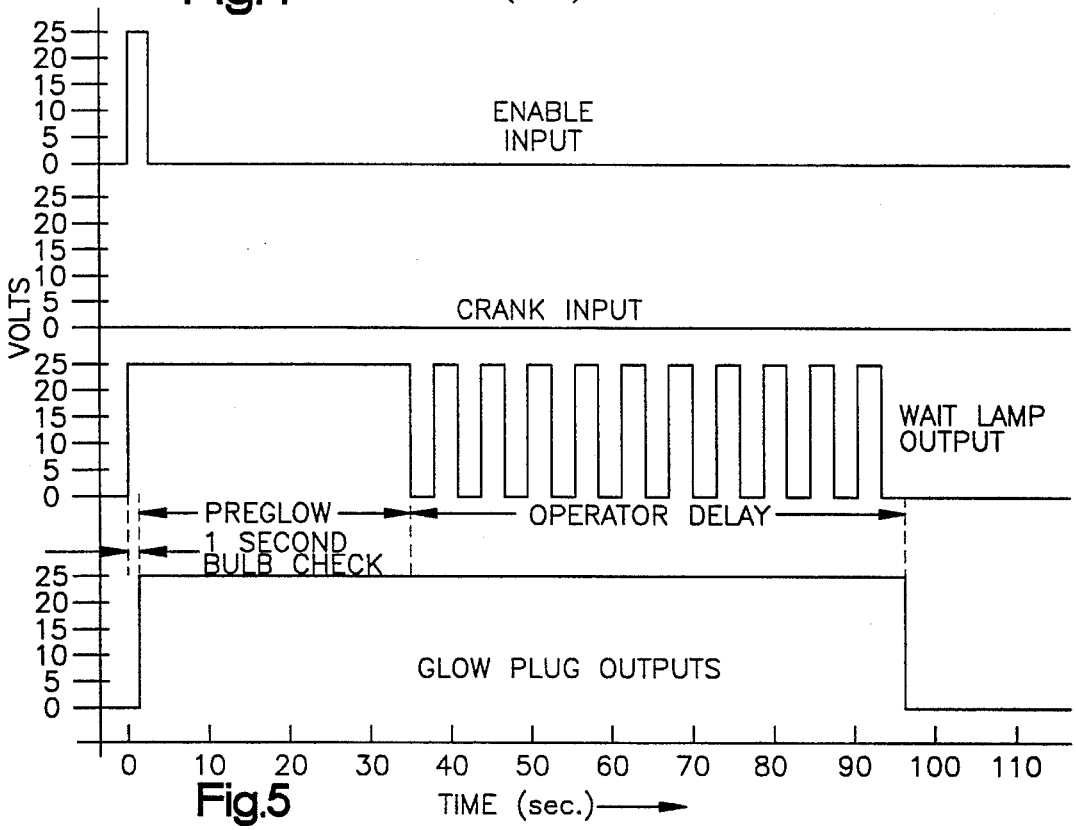
FIG. 5 is a timing diagram for 35 seconds of pre-glow and no crank input for 60 seconds.

This response is illustrated in FIG. 5.

Figure 6:
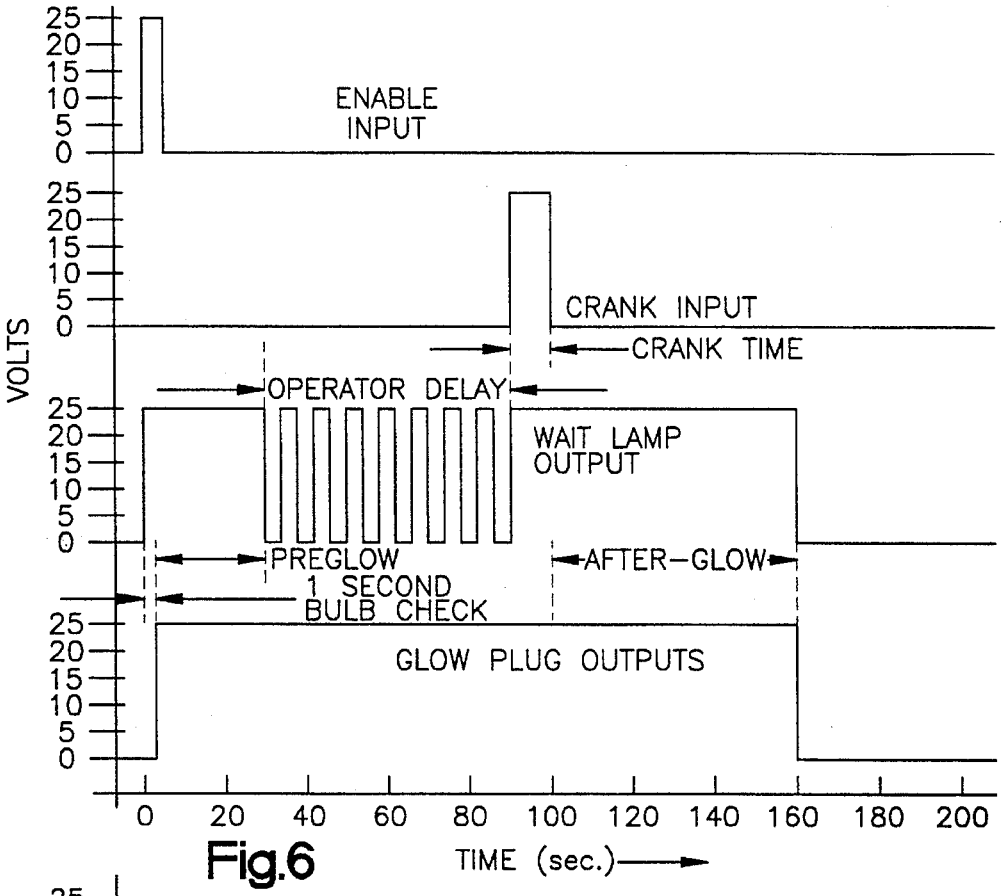
FIG. 6 is a timing diagram for 35 seconds of pre-glow, 55 seconds of operator delay, 10 seconds of crank time, and 60 seconds of after-glow.
Figure 7:
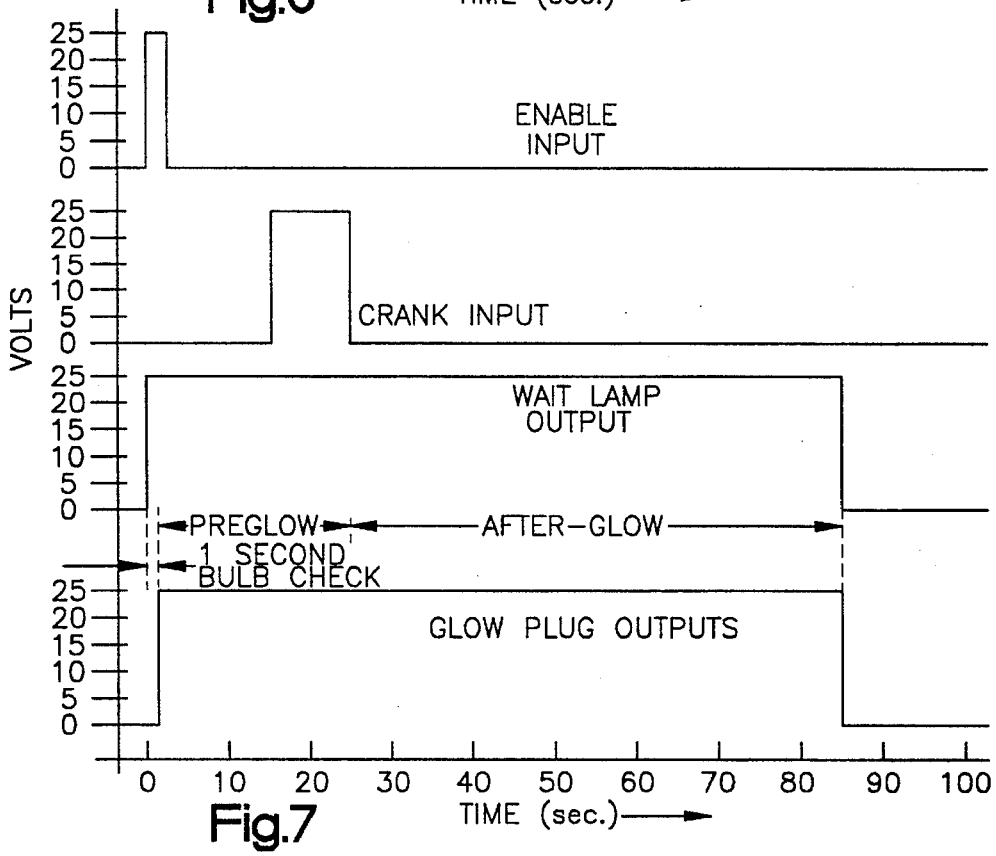
FIG. 7 is a timing diagram for crank input during pre-glow.
Figure 8:
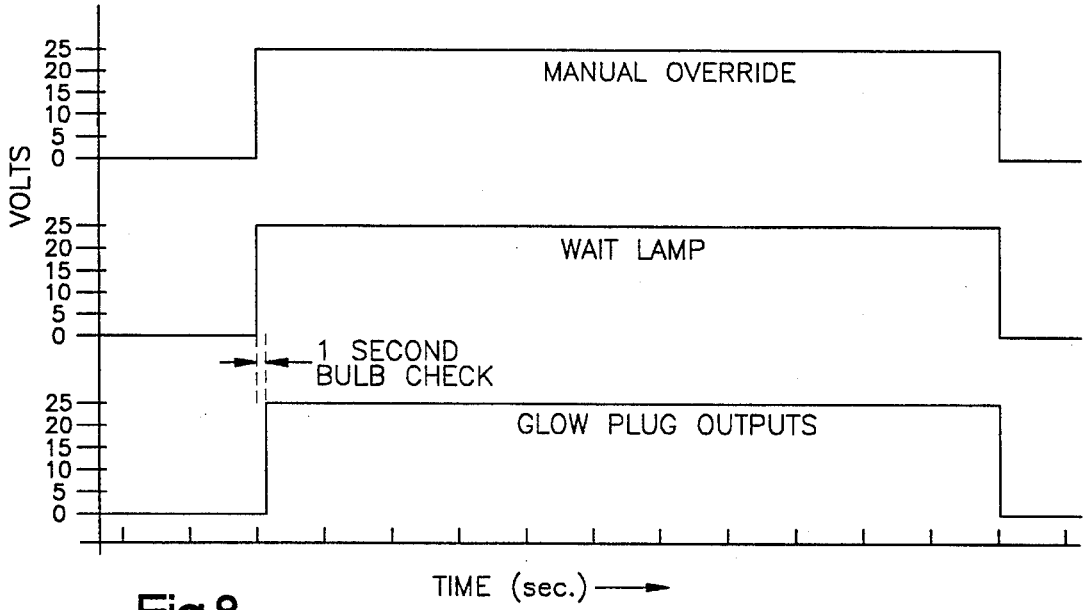
FIG. 8 is a timing diagram for manual override for a temperature of greater than 11 degrees Celsius and less then 85 degrees Celsius.
Figure 9:
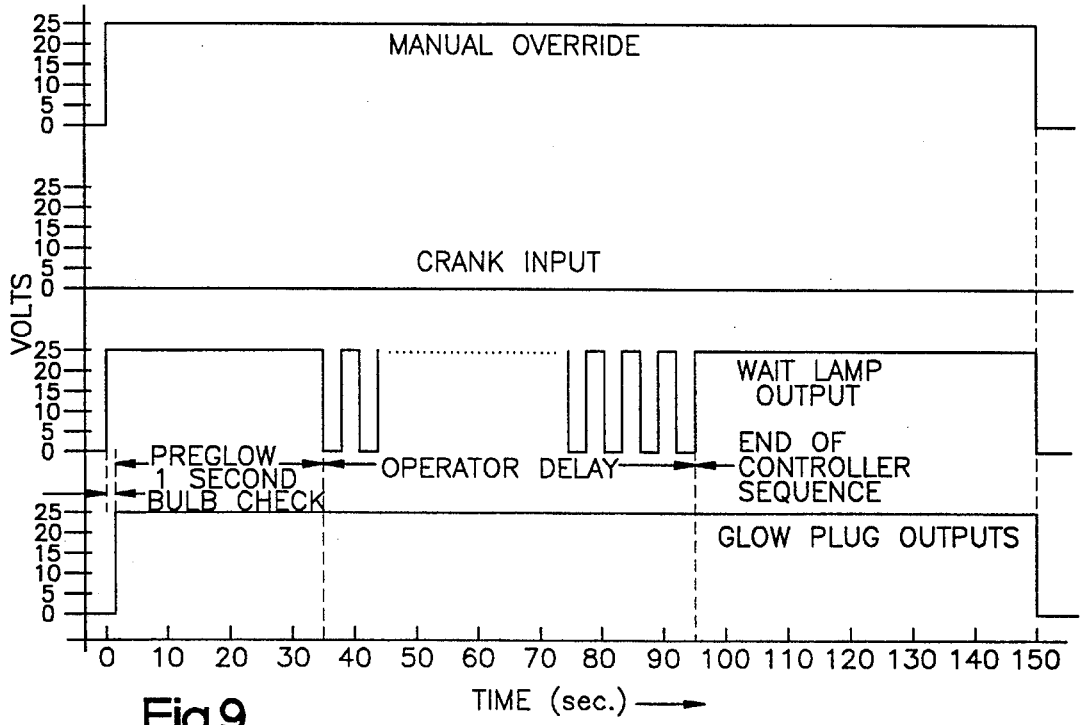
FIG. 9 is a timing diagram illustrating the sequence for manual override with background controller sequence.
Figure 10:
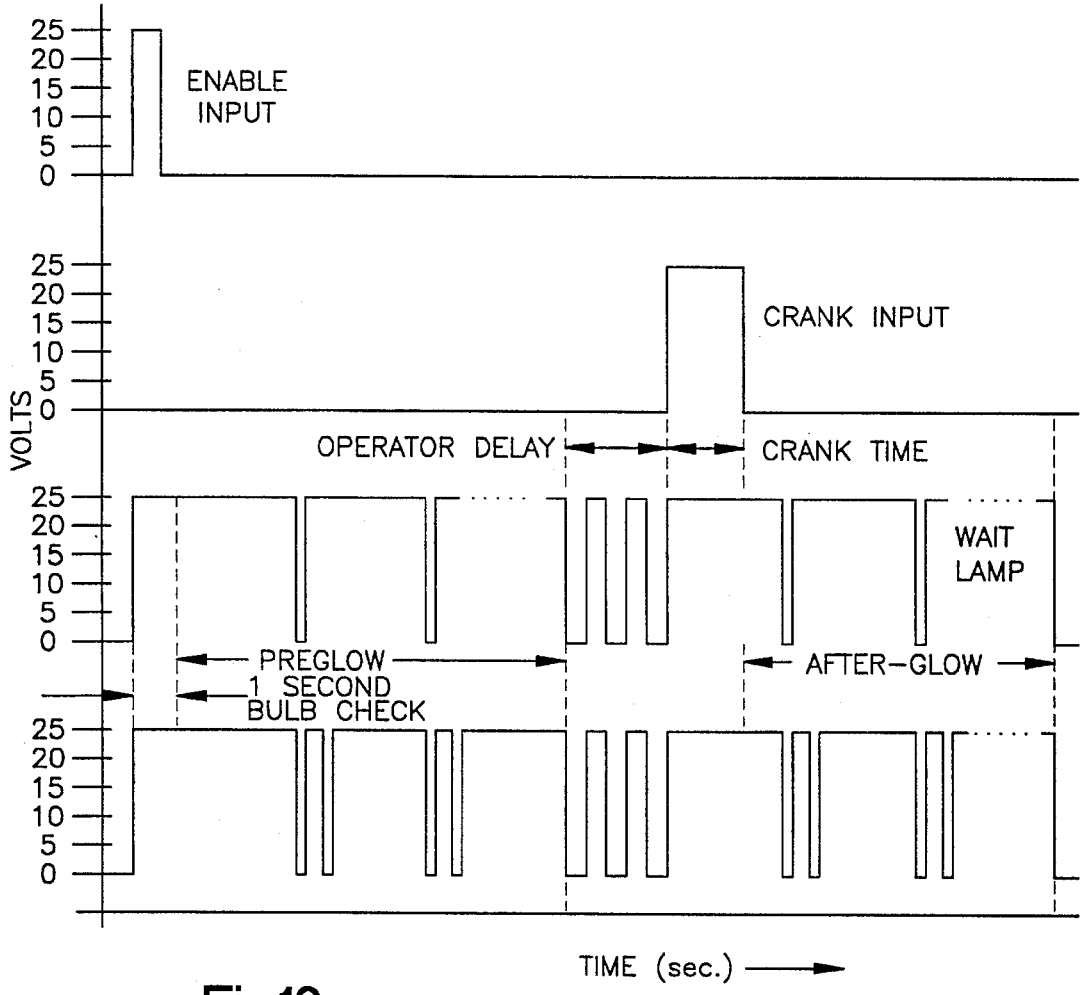
FIG. 10 is a timing diagram illustrating wait lamp operation for relay/fuse diagnostics. A bottom sequence of FIG. 10 has a repeat sequence of 3 seconds high, 0.2 seconds low, 0.3 seconds high, and 0.2 seconds low.
Figure 11A:
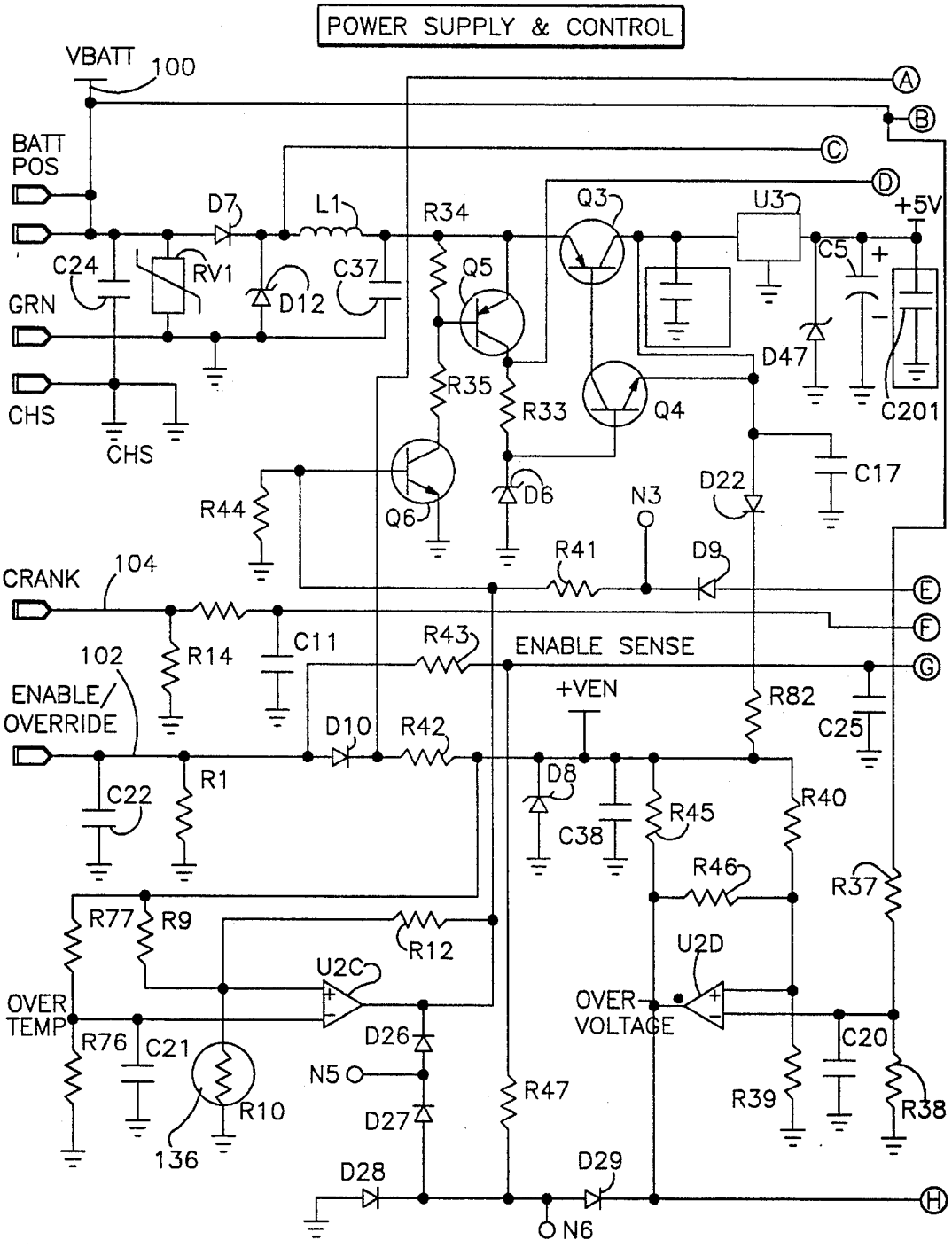
FIGS. 11A–11F together constitute schematic drawings of the circuitry of a preferred embodiment of the present invention.
Figure 11B:
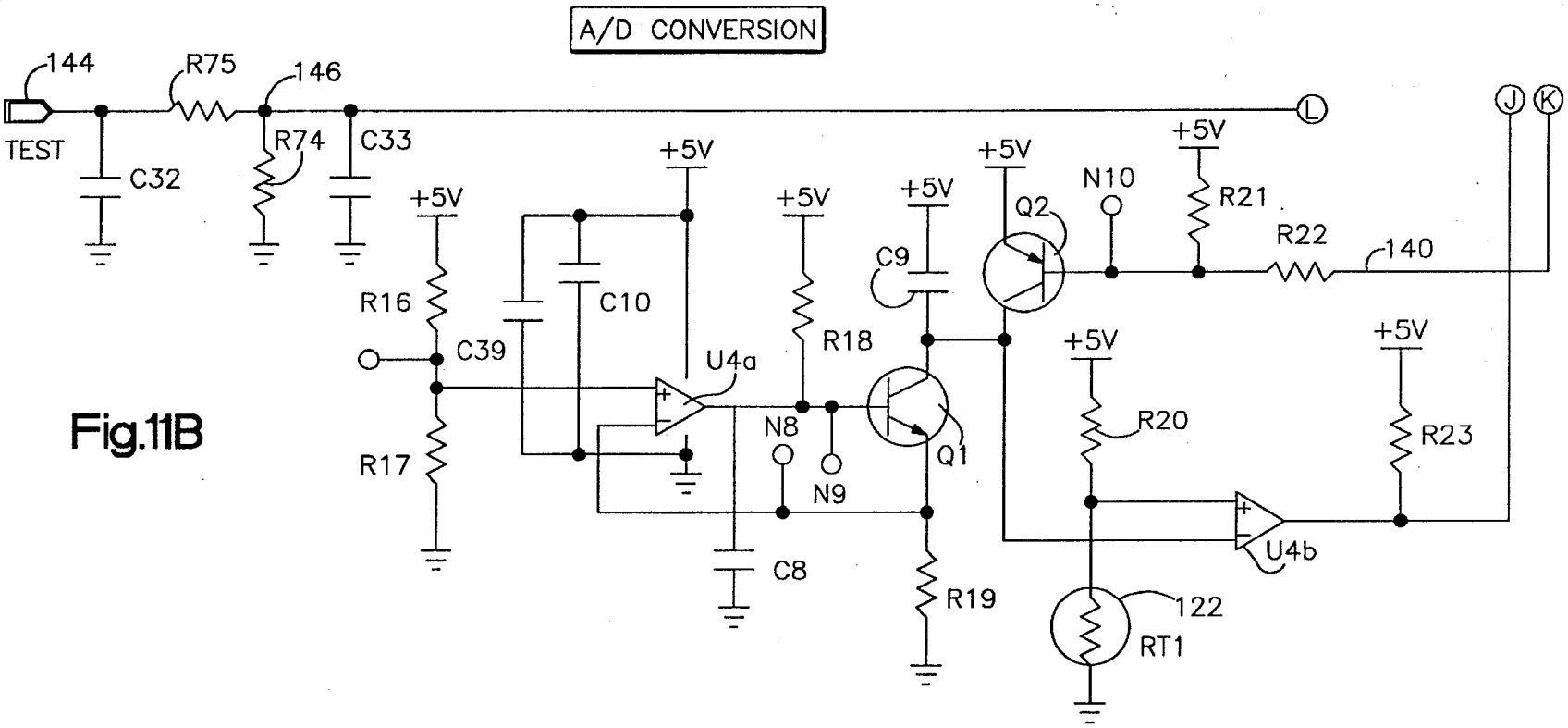
Figure 11C:
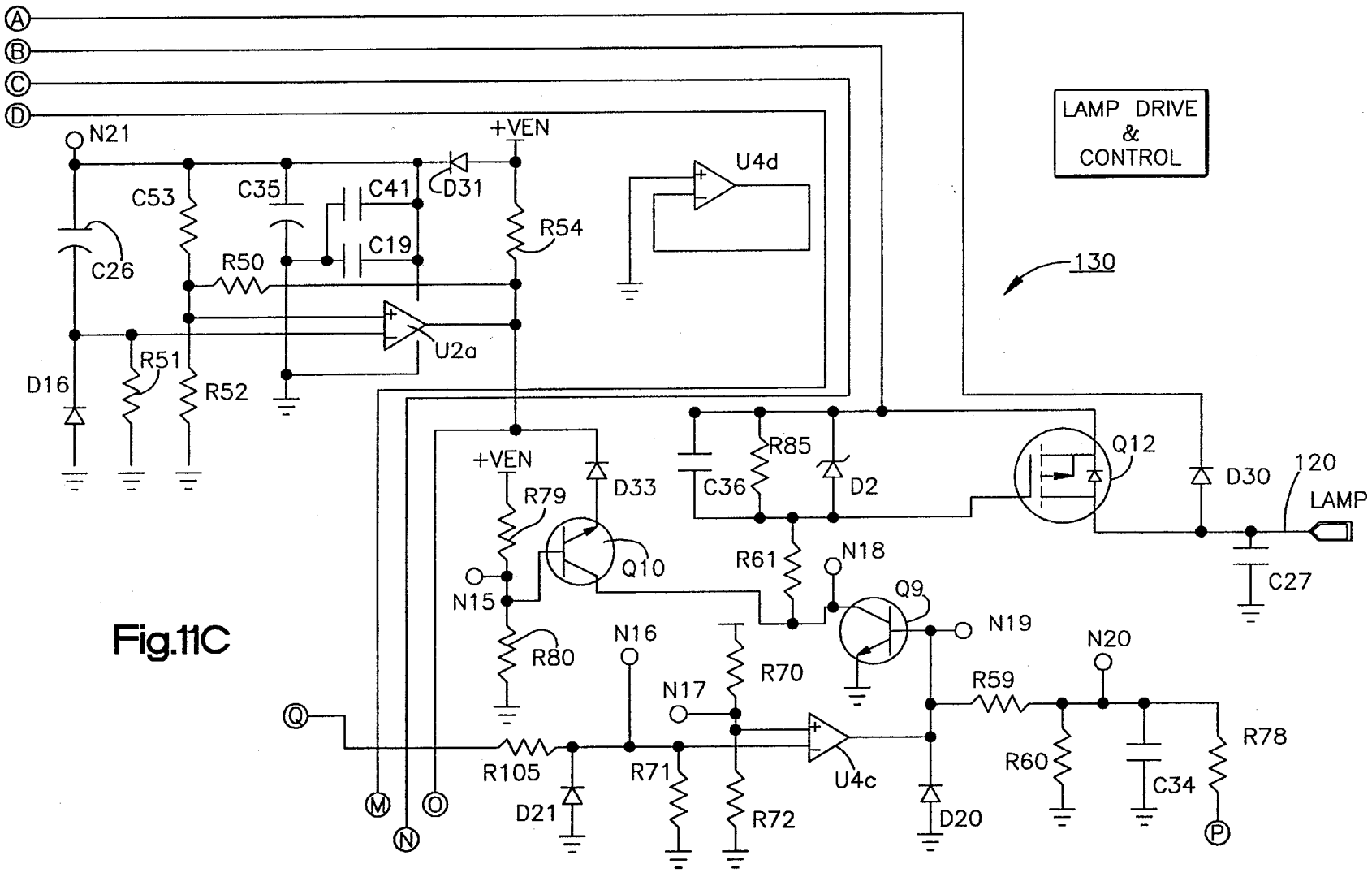
Figure 11D:
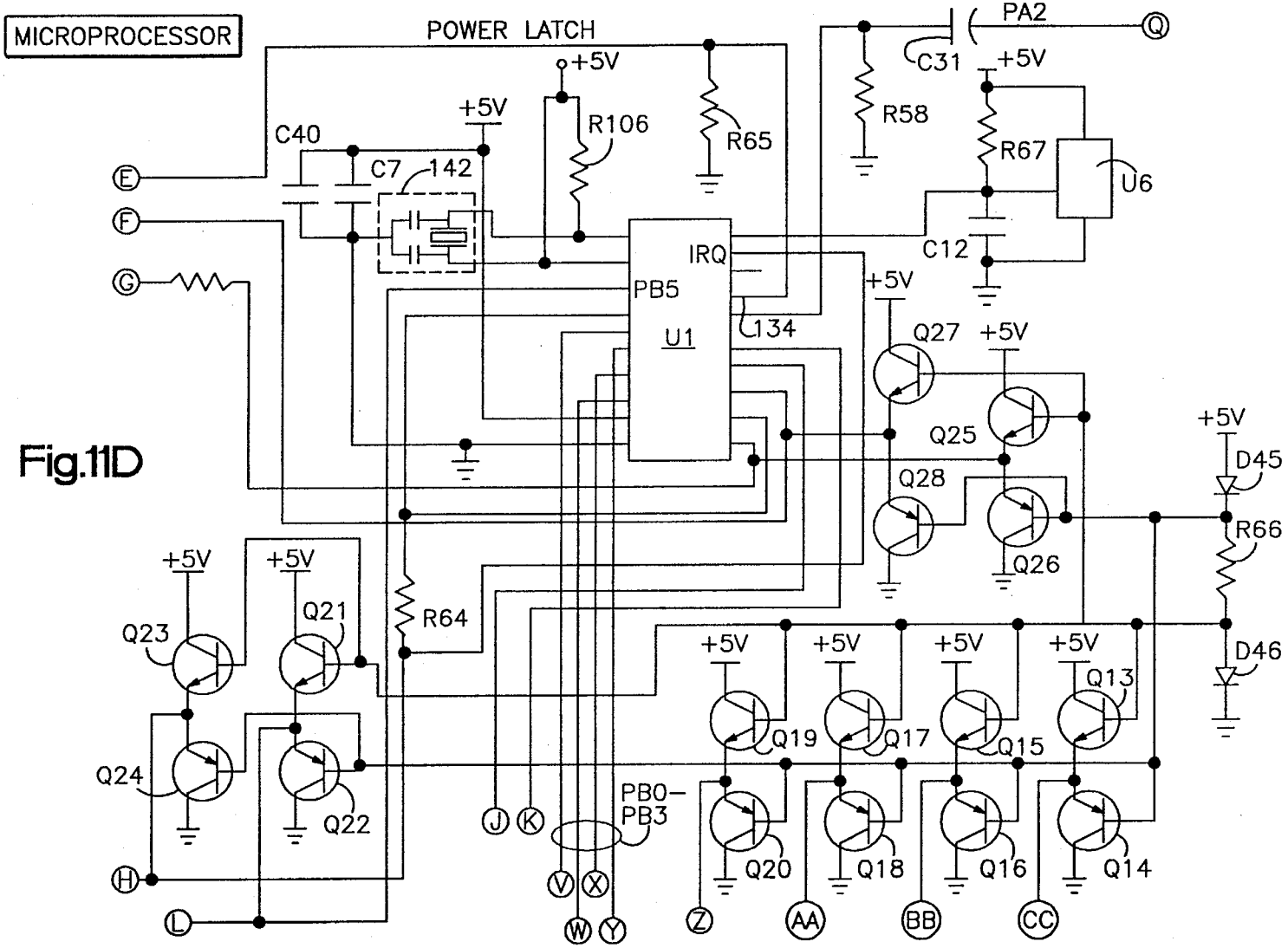
Figure 11E:
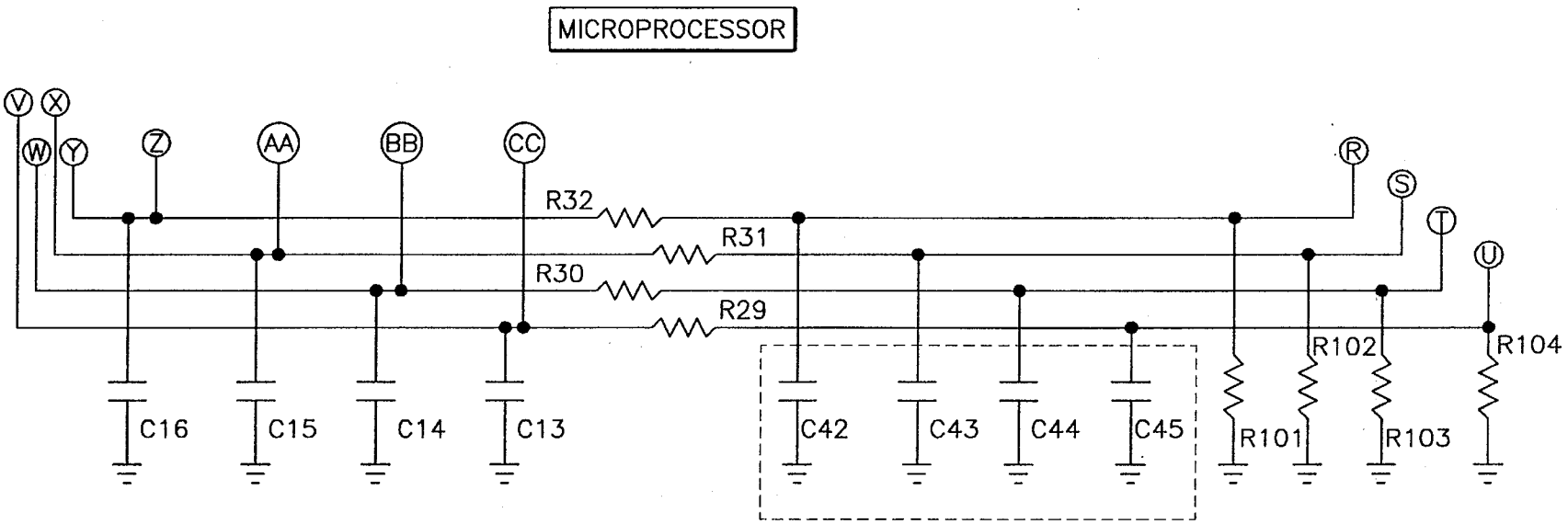
Figure 11F:
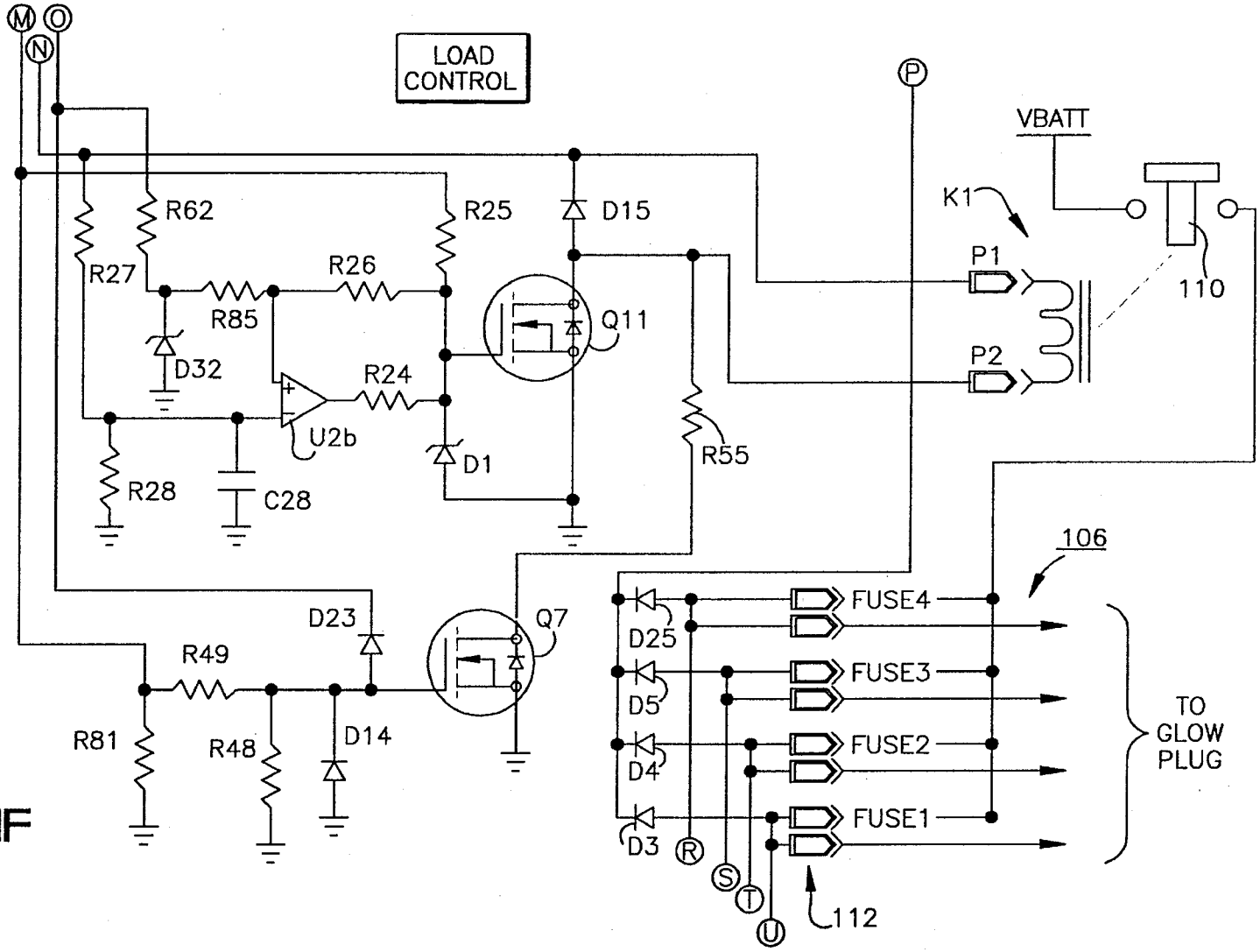

If the crank input undergoes a low to high transition during the operator delay, the controller waits for the crank input high to low transition, after which the after glow period is initiated. This sequence is illustrated in FIG. 6.

f. If the crank input is received during the pre-glow period, the pre-glow shall immediately terminate, and the after glow period shall begin as illustrated in FIG. 7.

g. The controller is activated by an ENABLE input signal of 10 volts DC or greater. If the input voltage decreases to 8 volts during the control cycle, the glow plug relays are not caused to drop out and the controller shall not be caused to reset.

h. The wait/pilot lamp operation is directly dependent upon relay operation. The lamp will be lit whenever the relay contact is closed and one or more of several fuses provides continuity. The lamp is off whenever all the fuses are open and/or the relay itself is open, except during the bulb check mode. The result is a lamp/relay interaction with the operator delay flash and the bulb check and relay/fuse diagnostic modes.

i. The manual override mode takes precedence over microprocessor functions, allowing direct operator control of the glow plugs at controller temperatures below 85° Celsius. One second after continuous activation of the operator enable/manual override switch, both the control cycle and manual override are simultaneously enabled. This sequence is illustrated in FIG. 9. If the switch is released prior to cycle completion, the microprocessor will complete the cycle before toggling the internal power supply. If the microprocessor is not functional, or the controller sensed temperature is in the range of 11° Celsius to 85° Celsius, the enable/override switch provides an emergency backup feature which enables the internal power supply and glow plugs while closed. An illustration of manual override for temperatures greater than 11° Celsius, but less than 85° Celsius, is provided in FIG. 8.

j. At controller temperatures below 11° Celsius, the relay/fuse diagnostic mode is active during both the preglow and afterglow periods. The diagnostic routine monitors the glow plug connector pins to determine whether the relay or any of the fuses are not operational. If one, two or three of the four fuses fail to source current, an error code is output via the wait lamp. The code alerts the operator that a malfunction exists and conveys the number of failed circuits. The code flashes one time per each failed circuit. The flash rate is 0.2 seconds off and 0.3 seconds on, with a three-second lamp-on period preceding the sequence. The error output will be repeated until termination of preglow and/or afterglow periods. The relay/fuse diagnostic routine is illustrated in FIG. 11.

THE POWER SUPPLY

Input power transient protection and EMI filtering are provided by a metal oxide varistor (MOV) indicated at reference character RV1, along with capacitors C24 and C37, an inductor L1 and a zener diode D12. A diode D7 provides reverse polarity protection in the event the vehicle battery is accidentally connected backward.

Transistors Q3 and Q4 form a pre-regulator, reducing the input voltage to a regulator indicated at reference character U3. A zener diode D6 sets the pre-regulator output to 7 volts. The regulator U3 provides 5 volts at its output, so the regulator U3 has only two volts dropped across it which allows the use of a small non-heat-sinked transistor regulator.

Capacitors C5 and C201 provide noise filtering for the 5 volt supply.

Current for a pre-regulator zener diode D6 is provided by way of a transistor Q5, which is under the control of a transistor Q6. At turn-on, a voltage from a vehicle enable/override switch appears at a point designated ENABLE. This voltage is filtered by a capacitor C22 (which also protects against ESD.) A diode D10 constitutes a blocking diode whose function is described below.

An incoming enabling voltage is regulated by a resistor R42 and a zener diode D8, and is applied to a Vcc terminal (via D31) of an integrated circuit comparator U2a, which is located in a lamp driver and control circuit to be described in more detail below.

An integrated circuit comparator U2c, due to sharing a common substrate with the integrated circuit U2a, now becomes powered up. A voltage from the point designated ENABLE is fed through a resistor R43 to a point indicated as ENABLE SENSE (see FIG. 12A). This voltage is then fed round about, via a resistor R47, a diode D27 and a diode D26 to the output of the integrated circuit U2c, and then to the base of the transistor Q6. The transistor Q6 then turns on, in turn allowing the transistor Q5 to turn on. The pre-regulator/regulator circuits become powered, delivering +5 volts to a microprocessor, described in more detail below.

The microprocessor then verifies the ENABLE input and the temperature. If the temperature is 11° Celsius or less, the microprocessor energizes a lead indicated by the designation POWER LATCH (see FIG. 12D). The transistor Q6 is then held on by way of a diode D9 and a resistor R41.

The output of the transistor Q5 is also applied to a transistor Q7 and a transistor Q11, which function as relay drivers to enable relay turn-on. Thus, holding down the ENABLE/OVERRIDE switch will energize a glow plug relay even if the microprocessor system becomes inoperative and fails to latch power on.

Figure 12:
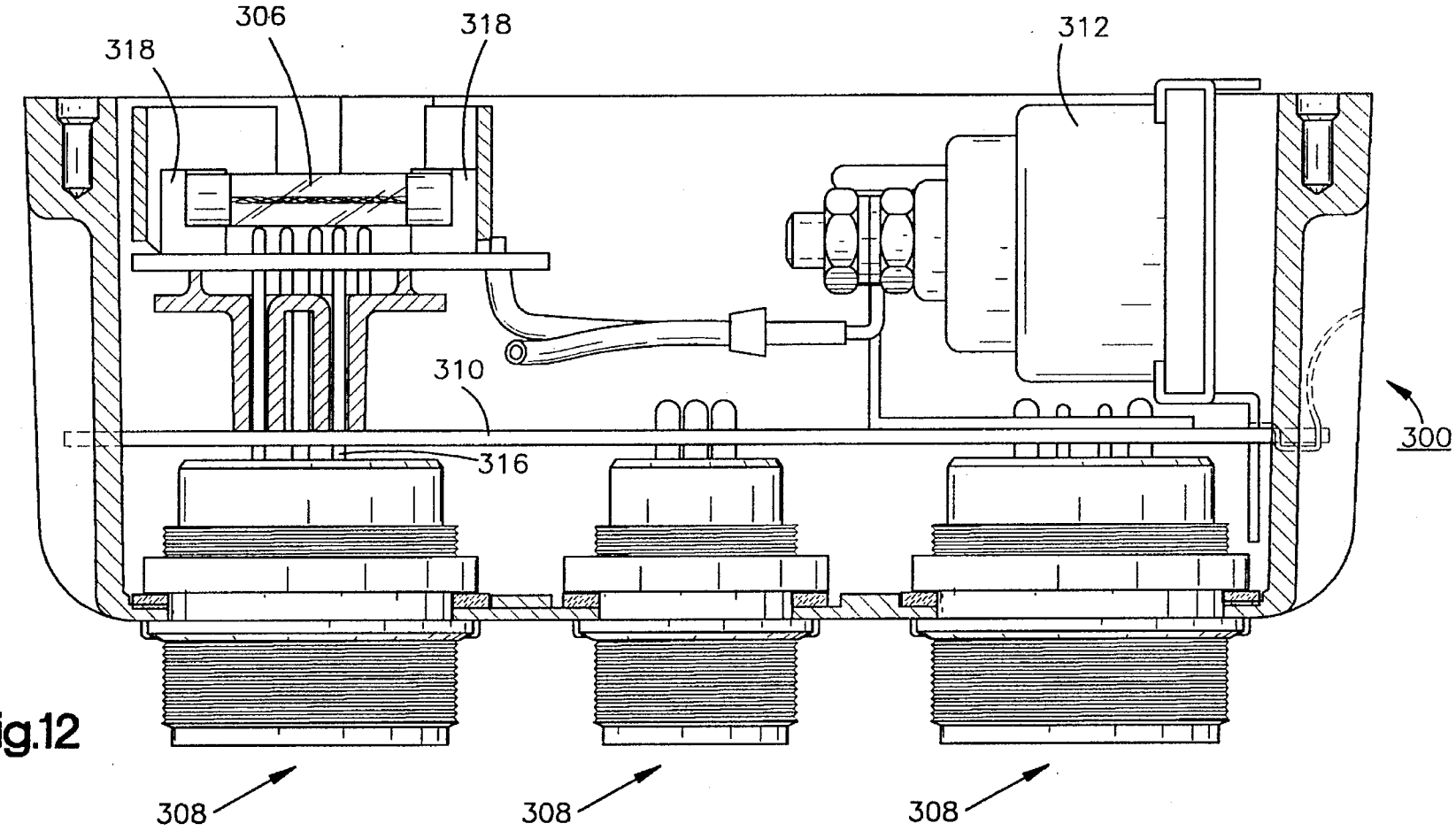
FIGS. 12–22 are mechanical drawings illustrating mechanical features of the present inventions.
Figure 13:
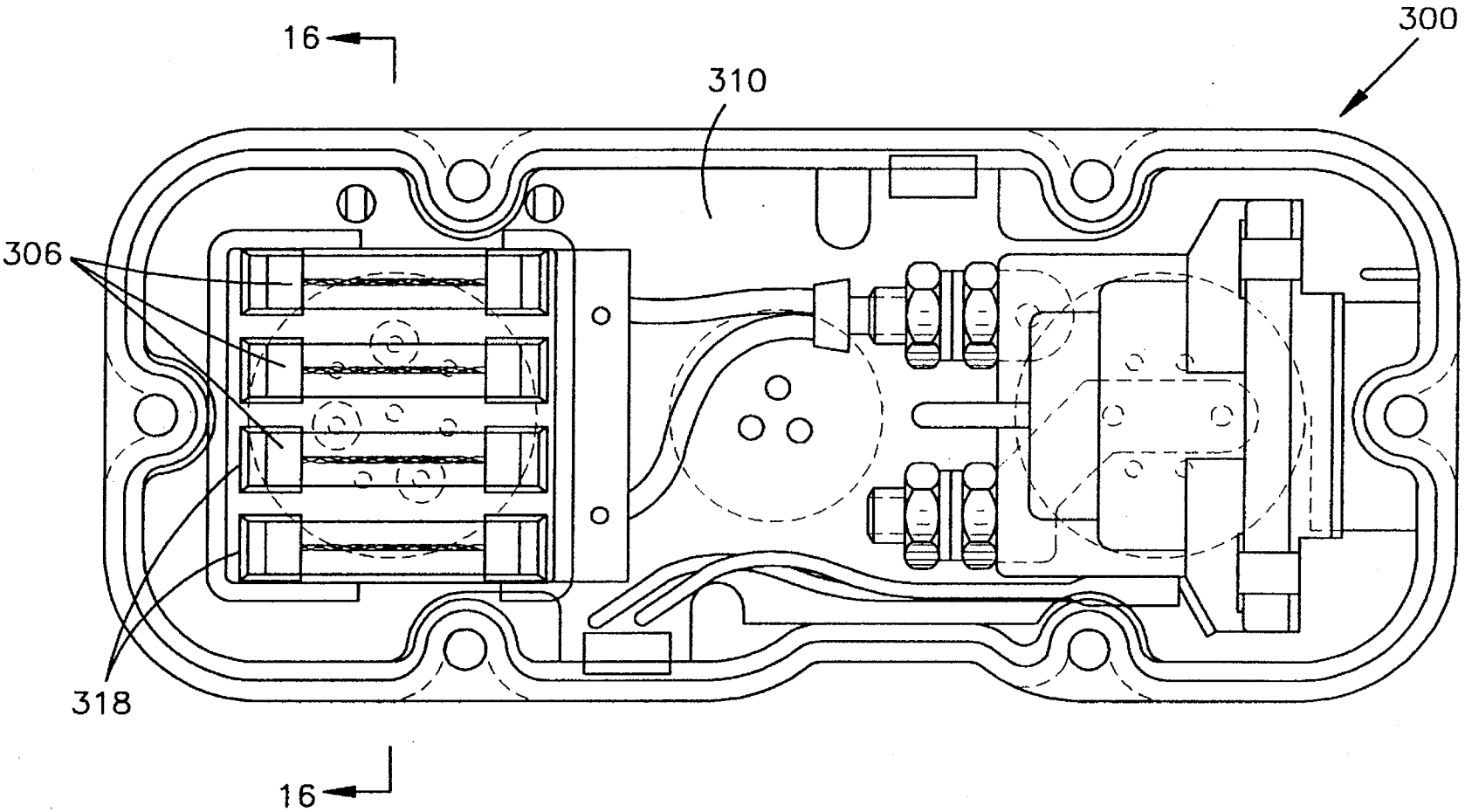
Figure 14:
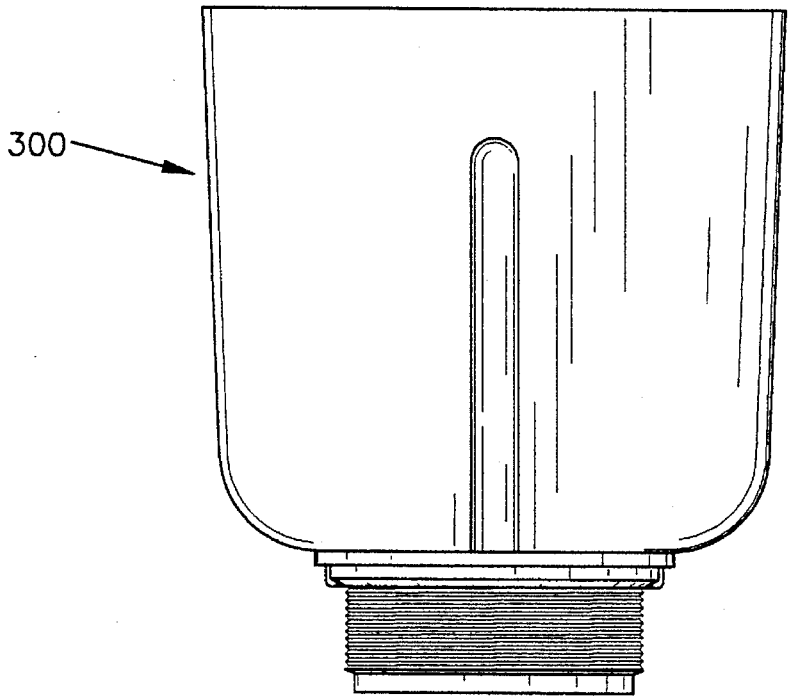
Figure 15:
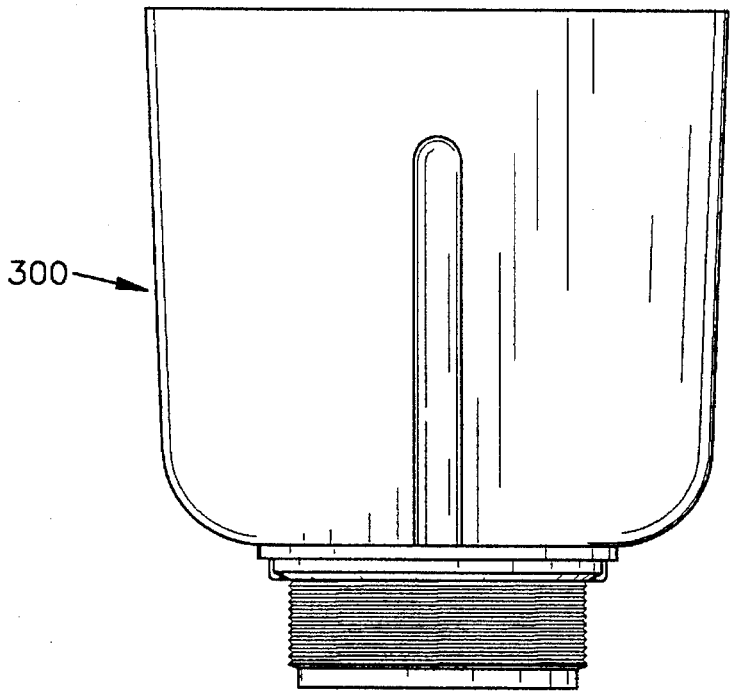
Figure 16:
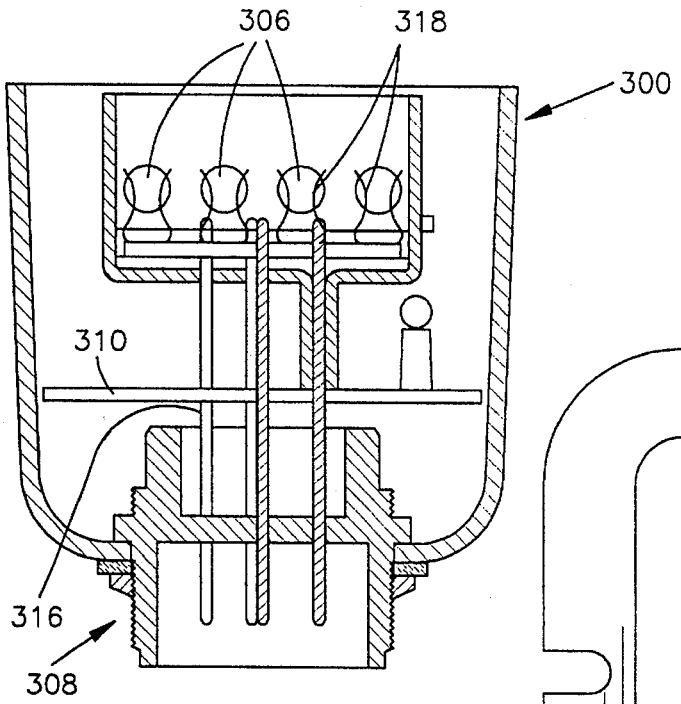
Figure 17:
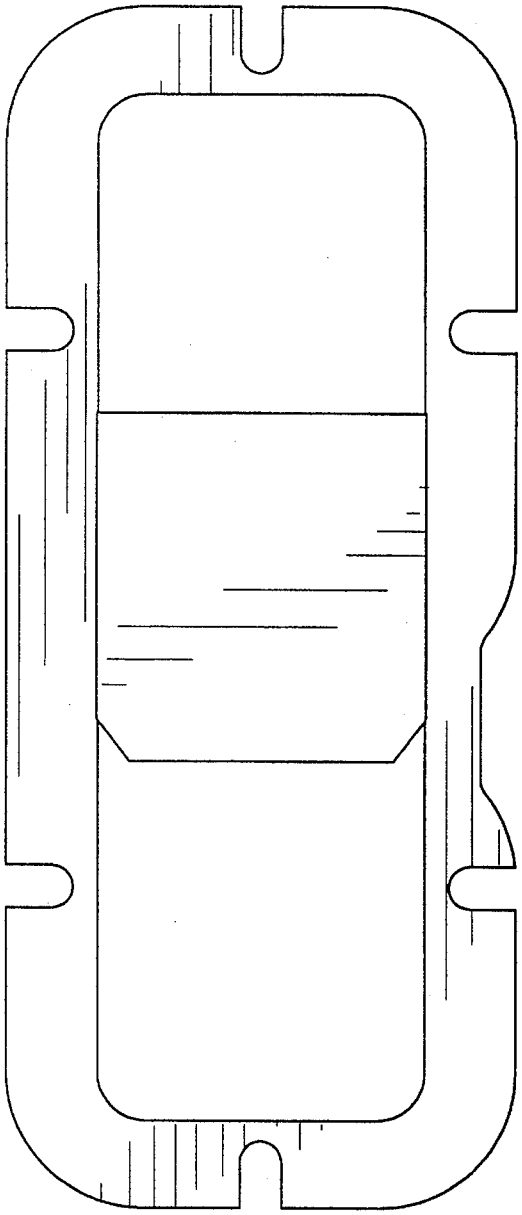
Figure 18:
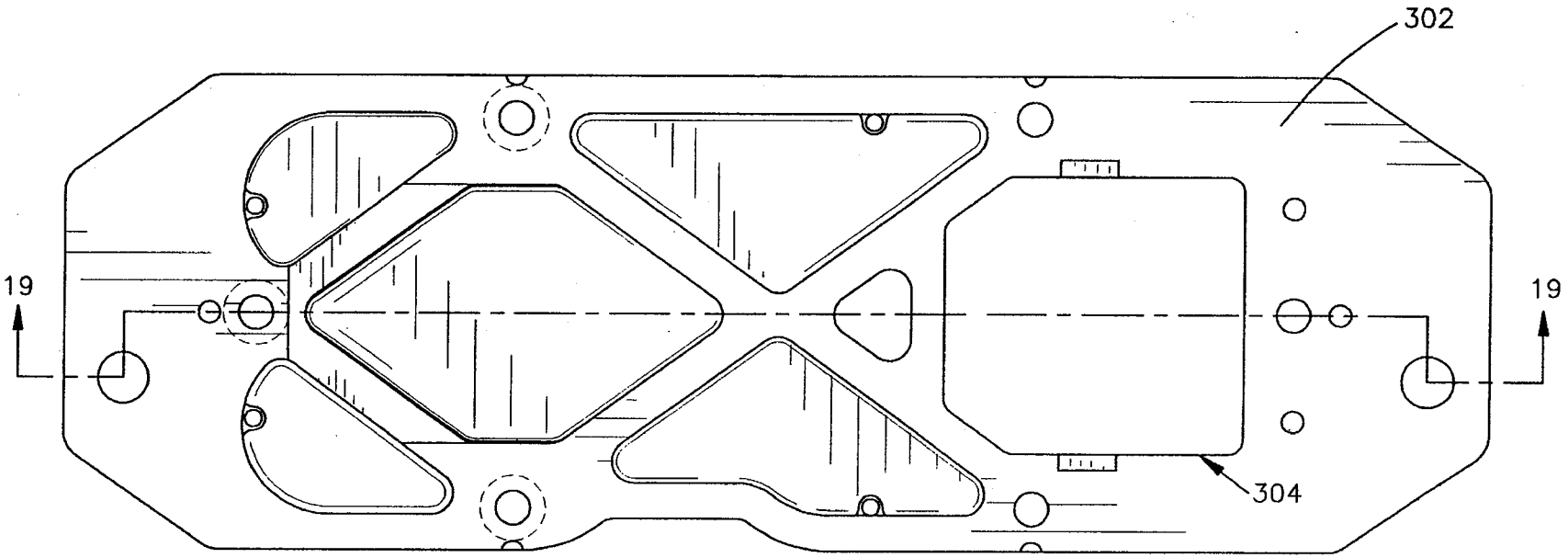
Figure 19:
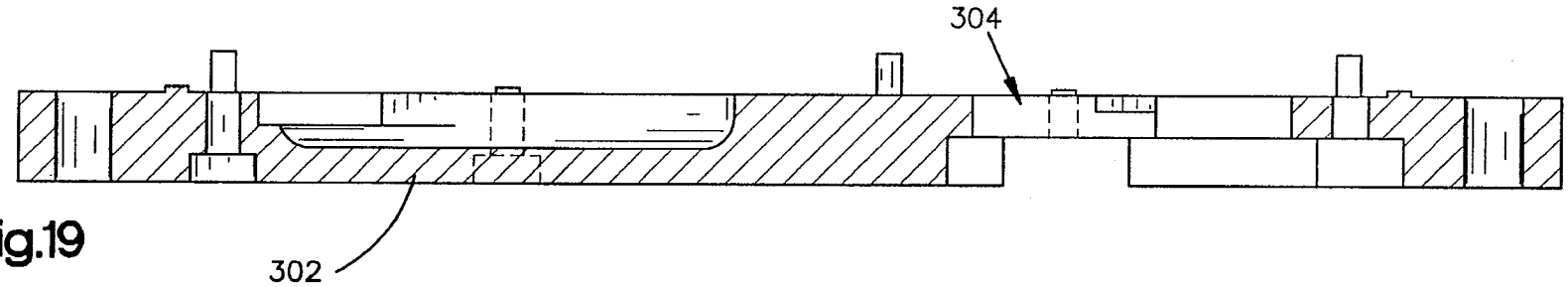
Figure 20:
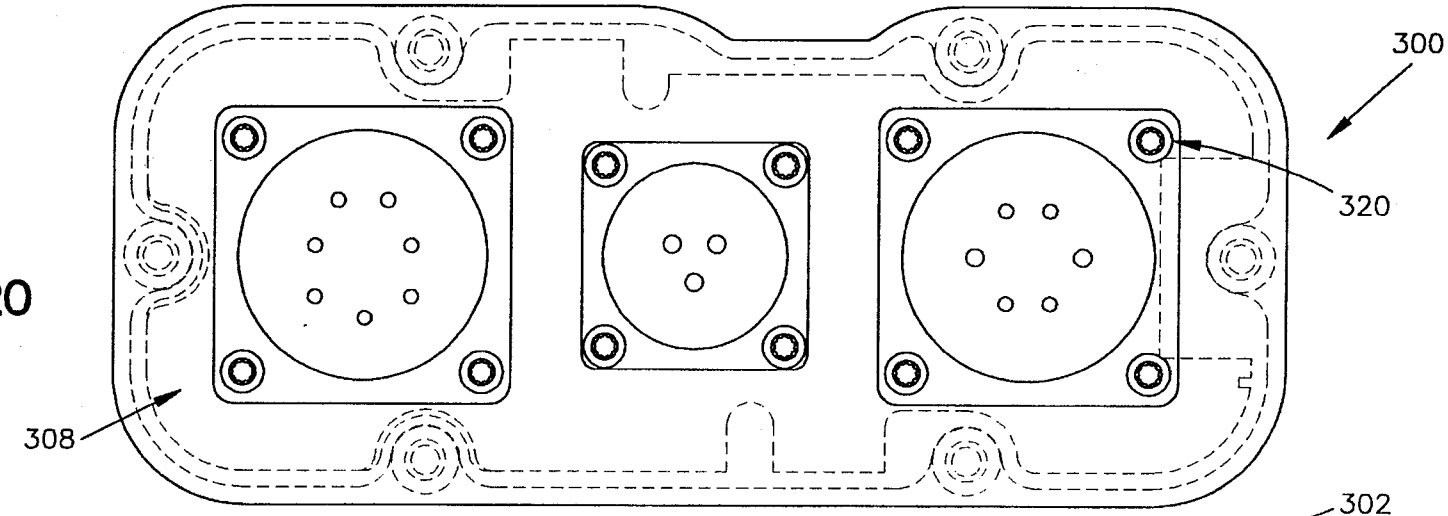
Figure 21:
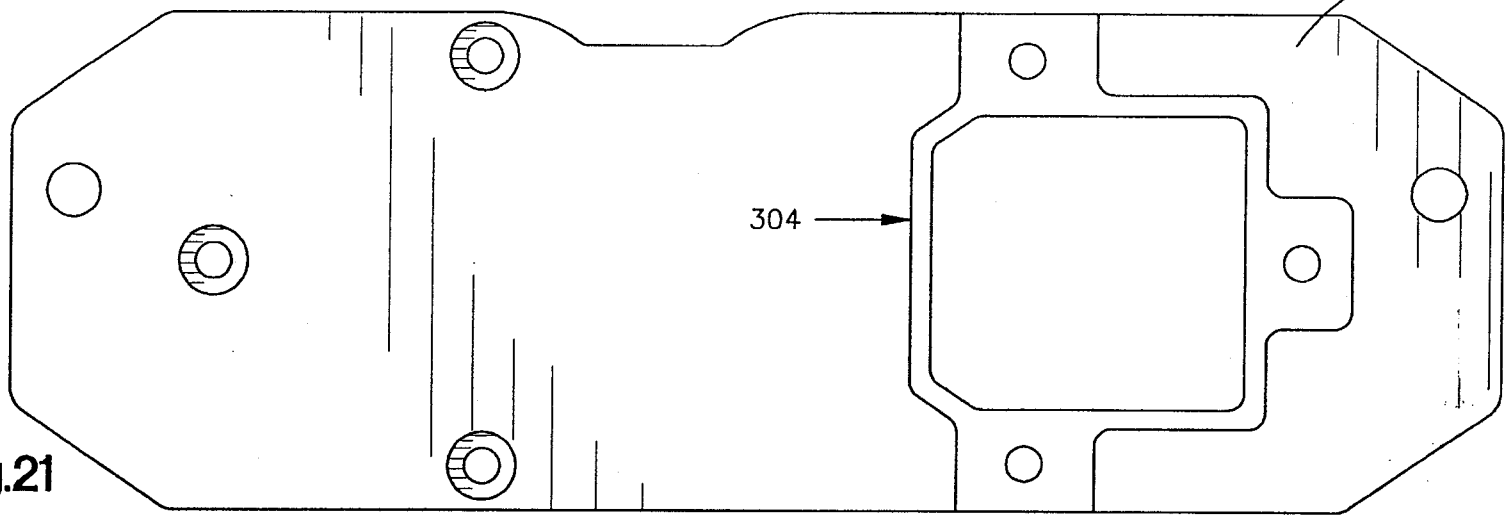
Figure 22:
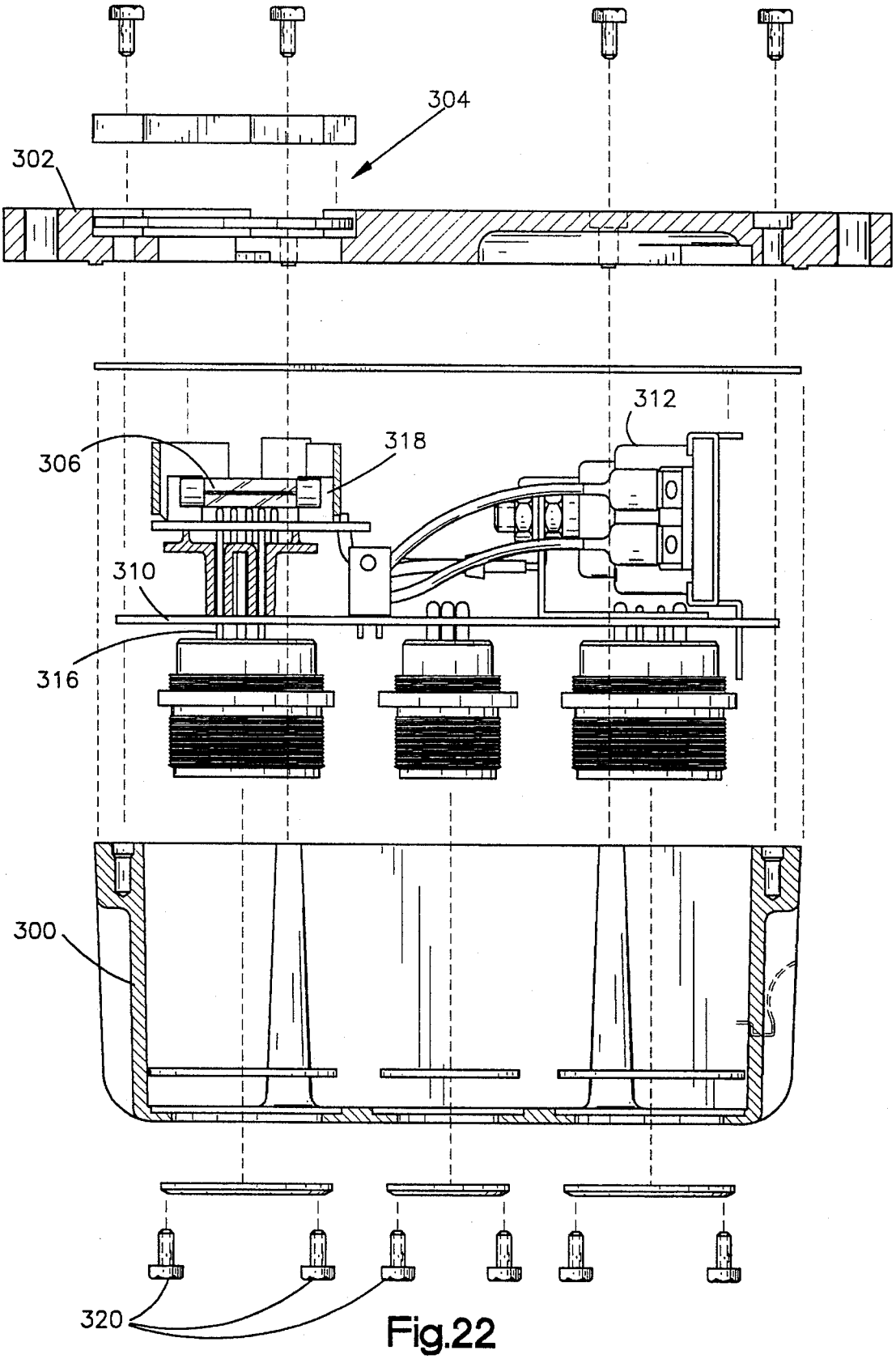

The vehicle battery voltage is monitored by an integrated circuit U2d designated OVERVOLTAGE (see FIG. 12A). Battery voltage is scaled by resistors R37 and R38, and is applied to inverting input of the integrated circuit U2d.

A reference voltage is derived from a zener diode circuit including a resistor R42 and a diode D8. Reference voltage is scaled by R40 and R39 and is applied to a non-inverting input of the integrated circuit U2d. Should battery voltage exceed a safe level (approximately 33 volts) the integrated circuit U2d output goes low. Hysteresis is provided by positive feedback resistor R46 to prevent oscillation. This is sensed by a microprocessor interrupt input designated IRQ, which initiates immediate turn-off of the power latch. A diode D29 then clamps the voltage at a node designated N6 to a level insufficient to forward bias diodes D27 and D26. The transistor Q6, in response, turns off, which drops the transistor Q5, turning off the relay.

This arrangement ensures that the manual override cannot energize the relay during an overvoltage condition.

An OVER TEMPERATURE monitor uses an NTC-type sensor at a non-inverting input and a reference voltage at the inverting input of the integrated circuit U2c. Hysteresis is provided by a positive feedback resistor R12 to prevent oscillation. When a temperature of 85° Celsius or greater is sensed, the integrated circuit U2c output goes low. This pulls the base of the transistor Q6 low and prevents the power supply from becoming enabled. The manual override function is thus disabled as well since operation of the glow plugs is not needed at these higher temperatures.

A/D CONVERSION

In order that the microprocessor can read the temperature sensor input signal, a conversion of the analog temperature signal to digital information is needed. The sensor is connected in series with a resistor R20 across the 5 volt power supply. As the sensor resistance varies with temperature, the voltage appearing at a non-inverting input of an integrated circuit U4b will vary. An integrated circuit U4a and a transistor Q1 together form a constant current source which allows a capacitor C9 to charge at a linear rate. The instantaneous voltage across capacitor C9 is applied to the inverting input of the integrated circuit U4b. In operation, a transistor Q2 is caused to conduct due to an output from the microprocessor, which is indicated by the reference character U1. This discharges the capacitor C9.

At time 0, the transistor Q2 turns off and the capacitor C9 begins to charge. The microprocessor begins incrementing an internal timer. At some point, the negative going capacitor voltage falls below the sensor derived voltage, and the circuit U4b output goes high. This signals the microprocessor to stop incrementing the internal timer.

The microprocessor timer count is a direct function of voltage at the non-inverting input of U46. This voltage, in turn, is a function of the sensor RT1 temperature.

The microprocessor then causes the transistor Q2 to again conduct, discharging capacitor C9 to begin another measuring cycle.

THE MICROPROCESSOR

Most timing and control functions are performed by the microprocessor. The engine temperature is input by way of the analog to digital converter circuitry, and the preglow interval is begun. A signal from the crank input causes timing to shift to the afterglow interval.

The instrument panel lamp is controlled to signal the vehicle operator of the controller states of operation, namely, preglow, time to crank, afterglow, and a diagnostic signal to indicate blown fuses.

A two MHz. resonator provides frequency control for the internal clock oscillator of the microprocessor. An input with a large ratio voltage divider is connected to a port which is designated by reference character PB5. This is a test input, and requires 120 volts to be applied in order that sufficient voltage is available at the divider output defined by resistors R74 and R75 in order that they constitute a high at the port.

This input is not a user input. It is designed to allow production facility testing at temperatures higher than 11° Celsius. This signal voltage is not readily available in the field, but could be used by personnel at a vehicle service facility. This function is transparent to the vehicle operator.

Note that transistor pairs are connected to all ports of the microprocessor which are in any way connected to the outside world. A group of transistors Q13 through Q28 form bi-polar transient protector/clamps which protect the microprocessor ports from overvoltage or reverse voltage.

The clamps possess novelty in form in the fact that voltage cannot go above +5 volts or below ground. Normal transient protection would use diodes across each input.

Such a diode configuration would permit the voltage on a port to exceed +5 or ground by a diode drop, which is 0.7 volts.

The specification on this CMOS part calls for clamping at a voltage not to exceed 0.5 volts beyond +5/ground. Consequently, "active" clamping circuits are employed.

As an example, attention is invited to the transistor pair including transistors Q13 and Q14. Note that the base of Q13, an NPN transistor, is held at one diode drop above ground by a diode D46, while the NPN transistor Q14 base is held one diode drop below +5 volts by a diode D45. In operation, if the emitter of the transistor Q13 goes to ground, an emitter-base junction voltage of 0.7 volts occurs due to the voltage across the diode D46. If the emitter of the transistor Q13 tries to go below ground, the transistor Q13 goes into conduction clamping the emitter to ground. Similarly, if the emitters of these two transistors try to go above +5 volts, the transistor Q14 will conduct, clamping the emitters of the transistors Q13, Q14 to +5 volts.

Under "brown out" conditions (severe sag in battery voltage), the microprocessor may go into an indeterminate state. A circuit U6 constitutes a low voltage monitor whose output will pull the reset port RST of the microprocessor to ground when the +5 volts supply dips below 4.6 volts, thus resetting the microprocessor.

LAMP DRIVER AND CONTROL

A P-channel field effect transistor (FET) is used to control power to the instrument panel indicator lamp. On power up (enable), the integrated circuit U2a output is pulled low since a capacitor C26 holds the inverting input high while it charges through a resistor R51. The emitter of a transistor Q10 is thus low, while the base sees a voltage set by two resistors R79 and R80. The transistor Q10 then turns on, assuming R79 and R80 are sufficiently biased, pulling the gate of a field effect transistor Q12 lower than the source. The field effect transistor Q12 applies power to the instrument panel lamp, and also applies a self-latching feedback voltage to the cathode of D10 by way of a diode D30.

A diode D10 at the enable input blocks this voltage from the ENABLE SENSE line. The purpose of this feedback voltage is to ensure that the system stays up long enough to perform a solid one second lamp bulb check, regardless of the duration of closure of the ENABLE/OVERRIDE switch input.

When a capacitor C26 charges to below the voltage set by resistors R52 and R53, the integrated circuit U2a is turned off and the transistor Q10 is turned off as well. Thus, causing its output to be pulled to +Ven via R54. This reverse bias Q10 BE Junction, thus turning Q10 off.

Further control of the lamp bulb driver circuit is provided by a transistor Q9, dependent upon the controller status.

During diagnostic lamp flashing, a signal from the microprocessor port PA2 is capacitatively coupled to a comparator integrated circuit U4c. In response to pulses from the microprocessor U1, the comparator U4c toggles the base of the transistor Q9, thus causing the lamp to be interrupted in the appropriate diagnostic patterns.

Note that turn-on bias for the transistor Q9 comes by way of a resistor R78 from the diode-OR circuit including diodes D3, D4, D5 and D25. Capacitive coupling of the diagnostic signal by way of a capacitor C31 ensures that the lamp check and manual override lamp function is retained even if the microprocessor should fail.

LOAD CONTROL CIRCUITRY

A glow plug power switching relay designated by reference character K1 is under the control of field effect transistors Q7 and Q11. A voltage delay signal from the lamp driver timer is applied to each field effect transistor circuit. This delay signal clamps the relay drivers OFF during the lamp check interval described above, to prevent relay operation until the microprocessor has had sufficient opportunity to become functional and measure the temperature.

If the temperature is above 11° Celsius, the power supply does not latch on, and the relay will not energize.

One requirement of the system is an extremely wide range of operating voltages (from 10 to 33 volts). Physical limitations of the relay will not permit reliable pull-in at 10 volts while not overheating at 33 volts. Note that the transistor Q7 drives the relay through a resistor R55. The relay is designed to pull in reliably at 10 volts, and maintain operations at 17 volts without overheating. The normal range of operation of the system is 24 to 30 volts, so the excess voltage is dropped across a resistor R55, (PWM techniques could optionally be used). Such techniques, however, can give rise to increased electro-magnetic interference potential.

When the battery voltage drops to about 17 volts, the comparator U2b (which had been on, holding the transistor Q11 turned off) turns OFF. Transistor Q11 then conducts, shorting out the circuit including resistor R55 and a transistor Q7, and applying full available voltage to the relay K1.

The output of the relay K1 ties to a buss connecting four fuses. The fuses feed four separate output connections for the glow plug circuits, and also feed the OR-diode D3, D4, D5 and D25. Additionally, a diagnostic input from each fuse output flows back to ports P80 through P83 on the microprocessor (see FIG. 12D), by way of resistor-capacitor noise filters including, respectively, resistor R29 and capacitor C13, resistor R30 and capacitor C14, resistor R31 and capacitor C15 and resistor R32 and capacitor C16. Resistors R101 through R104 are pull down resistors to establish a level if a fuse opens.

PART DESIGNATIONS

With reference to the schematic drawings discussed above, the following is an explanation of the function and part numbers for the various integrated circuit chips discussed above and identified generally by the prefix "U."

U1 is either a MC68HC05J1CP or MC68HC705J2CP microprocessor.

Each instance of a component designated by the prefix U2 is a comparator designated LM139. Each instance of a component designated by the prefix U3 preferably comprises a voltage regulator designated by Chip No. LP2950ACZ-5.0. Each instance of a component designated by the prefix U4 preferably comprises a quad comparator designated by Chip No. LM2901. The component designated U6 preferably comprises a chip designated MC33164.

MECHANICAL FEATURES

The mechanical aspects of the controller unit are shown in FIGS. 13 through 23.

The enclosure of the glow plug controller indicated at reference character 300, is a totally sealed aluminum die casting including bottom cover plate 302 defining a gasketed access port 304. The port allows accessibility to the fuses 306 for replacement. Location of this access port requires that the entire assembly be removed from the engine in order to replace fuses. This helps to ensure that only qualified service personnel can replace the fuses at which point they should have the knowledge and equipment to determine why the fuse blew in the first place, and correct the causative problem.

Waterproof connectors 308 conduct power and signal voltages in and out of the enclosure. Circuitry is carried on a printed circuit board 310, along with the power relay 312 (a totally enclosed solenoid) and the fixed connectors. A small printed circuit board mounts the fuse clips 318, and is supported off the main board by extended connector 316 on the glow plug controller.

The complete electronic assembly can thus be built and tested as a unit, then placed into the enclosure. The main board is encapsulated in place with potting compound to support all components against vibration. Of course, the fuse board is exposed, being above the level of potting. Attachment screws 320 are placed through the housing into threaded holes on the connection flanges prior to potting. Attachment of the bottom gasket and base plate complete the assembly.

SOURCE CODE FOR A REPRESENTATIVE MICROPROCESSOR PROGRAM

Appendix A to this specification includes five separate source code listings for implementing the microprocessor operation according to the descriptions of operation function as set forth in the foregoing specification. As mentioned in the foregoing specification, the microprocessor performs a multiplicity of functions related to monitoring and control of engine and glow plug operation. The source code listings are representative of one possible set of implementations of the present invention. Those of ordinary skill in the programming art familiar with systems as outlined in the specification will understand that alternate mechanisms for implementing microprocessor operation are possible.

It should be emphasized that the techniques defined in the source code listings of Appendix A are representative and are in no way intended to limit the scope of the present invention.

It should be appreciated that the present invention has been described with a certain degree of particularity, but that this illustration is not intended to limit the scope of the invention. It is therefore the intent that the invention include all modifications and alterations falling within the spirit and scope of the invention, as defined in the appended claims.

APPENDIX A

TABLE 1

Range and Resolution of Pre-glow Time vs. Sensor Temperature and After-glow Time vs. Pre-glow Time

| TEMPERATURE (Degrees C.) | PRE-GLOW TIME (seconds) |
|---|---|
| −40 | 0–80 in whole secs. |
| −37 | 0–80 in whole secs. |
| −34 | 0–80 in whole secs. |
| −31 | 0–80 in whole secs. |
| −28 | 0–80 in whole secs. |
| −25 | 0–80 in whole secs. |
| −22 | 0–80 in whole secs. |
| −19 | 0–80 in whole secs. |
| −16 | 0–80 in whole secs. |
| −13 | 0–80 in whole secs. |
| −10 | 0–80 in whole secs. |
| −7 | 0–80 in whole secs. |

TABLE 1-continued

Range and Resolution of Pre-glow Time vs. Sensor Temperature and After-glow Time vs. Pre-glow Time

| | |
|---|---|
| −4 | 0–80 in whole secs. |
| −1 | 0–80 in whole secs. |
| 2 | 0–80 in whole secs. |
| 5 | 0–80 in whole secs. |
| 8 | 0–80 in whole secs. |
| 11 | 0–80 in whole secs. |
| 14 | 0–80 in whole secs. |
| 17 | 0–80 in whole secs. |
| 20 | 0–80 in whole secs. |
| 23 | 0–80 in whole secs. |
| 26 | 0–80 in whole secs. |
| 29 | 0–80 in whole secs. |
| 32 | 0–80 in whole secs. |
| 35 | 0–80 in whole secs. |
| 38 | 0–80 in whole secs. |
| 41 | 0–80 in whole secs. |
| 44 | 0–80 in whole secs. |
| 47 | 0–80 in whole secs. |
| 50 | 0–80 in whole secs. |
| PRE-GLOW TIME (seconds) | AFTER-GLOW TIME (seconds) |
| >0 | 0–120 sec. constant in whole secs. |
| =0 | 0 |

TABLE 2

Actual Pre- and After-glow Times

| TEMPERATURE (Degrees C.) | PRE-GLOW TIME (seconds) |
|---|---|
| −40 | 35 |
| −37 | 35 |
| −34 | 35 |
| −31 | 35 |
| −28 | 35 |
| −25 | 35 |
| −22 | 35 |
| −19 | 35 |
| −16 | 35 |
| −13 | 35 |
| −10 | 35 |
| −7 | 35 |
| −4 | 35 |
| −1 | 35 |
| 2 | 35 |
| 5 | 35 |
| 8 | 35 |
| 11 | 35 |
| 14 | 0 |
| 17 | 0 |
| 20 | 0 |
| 23 | 0 |
| 26 | 0 |
| 29 | 0 |
| 32 | 0 |
| 35 | 0 |
| 38 | 0 |
| 41 | 0 |
| 44 | 0 |
| 47 | 0 |
| 50 | 0 |
| PRE-GLOW TIME (seconds) | AFTER-GLOW TIME (seconds) |
| >0 | 60 |
| =0 | 0 |

We claim:

1. Apparatus for governing application of electrical power to a plurality of glow plugs in a diesel engine that applies motive power to a motor vehicle, said apparatus comprising:

a) a temperature sensor for producing a temperature signal corresponding to a temperature at a region of said diesel engine;

b) a programmable controller for controlling application of electrical power to the glow plugs of said diesel engine; said programmable controller including i) a power input coupled to a motor vehicle battery; ii) a temperature input coupled to the temperature sensor for monitoring said temperature signal iii) a stored program for determining a glow plug pre-glow period as a function of sensed temperature from the temperature sensor: iv) an enable input to signal the stored program to determine a pre-glow time period and v) an output for producing a glow plug control signal during a pre-glow time period determined by the stored program in response to receipt of the enable input, said stored program distinguishing between two different signals at the enable input to allow the motor vehicle operator to manually override the pre-glow energization time period;

c) output circuitry coupled to the programmable controller for responding to the glow plug control signal from the programmable controller and applying electrical power to the glow plugs;

d) a waterproof housing for the programmable controller that is attached to the diesel engine for enclosing the programmable controller; and e) structure for supporting the glow plug controller and the temperature sensor within the waterproof housing.

2. The apparatus of claim 1, further comprising:

circuitry defining an input for a temperature representing signal from a source other than from said temperature sensor and for facilitating said programmable controller processing said temperature representing signal as if said temperature representing signal had, in fact, been produced by said temperature sensor.

3. The apparatus of claim 1 further comprising:

a) a relay electrically coupled to the output from the programmable controller for selectively opening and closing a circuit conductively connecting the glow plugs to the vehicle battery;

b) a fuse interposed in said circuit connecting the vehicle battery with said glow plugs.

4. The apparatus of claim 3, further comprising circuitry for monitoring whether said fuse has broken said connecting circuit.

5. The apparatus of claim 4, further comprising indicator circuitry for producing an indication in response to said monitoring circuitry for indicating when said fuse has opened said connecting circuit.

6. The apparatus of claim 5, wherein said engine has a plurality of glow plugs and a plurality of said circuit for connecting said glow plugs to said electrical power source, said system further comprising:

a) each of said connecting circuits, including a fuse interposed therein; and b) said monitoring circuitry and said indicator circuitry comprising means for indicating to an operator the number of said open fuses.

7. The apparatus of claim 6, further comprising:

a wait lamp for warning a user not to start the engine and wherein the programmable controller defines a preglow period during which electrical power is applied to said glow plugs, and wherein the programmable controller actuates said wait lamp continuously during said preglow period when none of said fuses are open; and wherein said controller flashes said wait lamp in response to the monitoring of at least one of said fuses being open.

8. The system of claim 7, further comprising:

circuitry for selectively controlling the application of electrical power to various among the glow plugs, for disabling the application of electrical power to glow plugs in connecting circuits whose fuses are open, and for enabling application of power to those of said connecting circuits whose fuses are not open.

9. The apparatus of claim 3, wherein said diesel engine includes an even number of glow plugs, said system further comprising a plurality of said connecting circuits, each said connecting circuit connecting a unique pair of said glow plugs to a source of electrical power.

10. Apparatus for governing application of electrical power to a one or more glow plugs in a diesel engine, the diesel engine having associated therewith a starter for starting the engine, said apparatus comprising:

a) a user actuated switch for applying power to the glow plugs prior to starting the engine;

b) user actuated apparatus and circuitry for actuating said starter and for producing a cranking signal only when said starter is operating;

c) a temperature sensor mounted to the diesel engine for monitoring an ambient temperature prior to starting of the diesel engine; and d) glow plug control circuitry comprising:

i) a programmable controller electrically connected to said temperature sensor and to said user actuated switch having a stored program that responds to actuation of said switch by calculating a preglow period if a sensed temperature as indicated by a signal from the temperature sensor is below a first set point temperature; and ii) output circuitry coupled to the programmable controller responsive to the cessation of said cranking signal to apply electrical power to said glow plug during an afterglow period initiated in response to cessation of said cranking signal.

11. The apparatus of claim 10, further comprising:

circuitry for applying electrical power to said glow plug during engine cranking as indicated by the cranking signal.

12. The apparatus of claim 10, further comprising:

apparatus and circuitry for providing an indication of the initiation of said afterglow period.

13. The apparatus of claim 10, further comprising:

apparatus and circuitry for providing an indication of the termination of the preglow period.

14. Apparatus for governing application of electrical power to a one or more glow plugs in a diesel engine, the diesel engine having associated therewith a starter for starting the engine, said apparatus comprising:

a) a user actuated switch for applying power to the glow plugs prior to starting the engine;

b) user actuated apparatus and circuitry for actuating said starter and for producing a cranking signal only when said starter is operating;

c) a temperature sensor mounted to the diesel engine for monitoring an ambient temperature prior to starting of the diesel engine; and d) glow plug control circuitry electrically connected to said temperature sensor, to said user actuated switch, and to the circuitry for actuating the starter; said glow plug control circuitry distinguishing between momentary and continuous user operation of the user actuated switch in responding to first and second set point temperatures that are sensed by the temperature sensor; wherein the control circuitry responds to either continuous or momentary actuation of said user actuated switch to apply electrical power to said glow plugs during a preglow period if the sensed temperature is below both the first and the second set point temperatures but wherein the control circuitry responds to only continuous actuation of sad user actuated switch to apply electrical power to said glow plugs during a preglow period if the sensed temperature is above a first set point temperature but below the second set point temperature;

e) said glow plug control circuitry responsive to the cessation of said cranking signal to apply electrical power to said glow plug during an afterglow period in response to cessation of said cranking signal.

* * * * *